US006588635B2

(12) United States Patent
Vor Keller et al.

(10) Patent No.: US 6,588,635 B2
(45) **Date of Patent: *Jul. 8, 2003**

(54) SAFETY HOLSTER FOR PREVENTING ACCESS TO A FIREARM BY UNAUTHORIZED USERS

(75) Inventors: Albert W. Vor Keller, Marietta, GA (US); David R. Fletcher, Atlanta, GA (US)

(73) Assignee: Safety First Devices, Inc., Atlanta, GA (US)

( * ) Notice: Subject to any disclaimer, the term of this patent is extended or adjusted under 35 U.S.C. 154(b) by 56 days.

This patent is subject to a terminal disclaimer.

(21) Appl. No.: 09/826,111

(22) Filed: Apr. 4, 2001

(65) Prior Publication Data

US 2001/0019071 A1 Sep. 6, 2001

Related U.S. Application Data

(63) Continuation-in-part of application No. 09/511,143, filed on Feb. 23, 2000, now Pat. No. 6,230,946.

(60) Provisional application No. 60/174,200, filed on Jan. 3, 2000.

(51) Int. Cl.[7] ..... F41C 33/02

(52) U.S. Cl. ..... 224/244; 224/911

(58) Field of Search ..... 224/244, 263, 224/242, 245, 911, 913, 912, 192, 193, 196; 211/64; 42/70.1, 70.6, 70.7, 70.8, 70.11

(56) References Cited

U.S. PATENT DOCUMENTS

| | | | | |
|---|---|---|---|---|
| 1,148,935 A | * | 8/1915 | Snavely | 224/243 |
| 1,173,376 A | | 2/1916 | Noye | |
| 1,421,578 A | * | 7/1922 | Schussler | 224/243 |
| 2,109,734 A | * | 3/1938 | Preneta | 224/244 |
| 2,551,913 A | | 5/1951 | Toby | |
| 2,708,537 A | * | 5/1955 | Dec | 224/196 |
| 3,558,090 A | | 1/1971 | Bird | |
| 3,718,240 A | | 2/1973 | Rose | |
| 4,747,280 A | | 5/1988 | Shaw | |
| 4,768,021 A | | 8/1988 | Ferraro | |

(List continued on next page.)

FOREIGN PATENT DOCUMENTS

| | | |
|---|---|---|
| WO | WO 00/65292 | 11/2000 |
| WO | WO 00/65528 | 11/2000 |

OTHER PUBLICATIONS

Ideamation, Inc.; Fingerprint Identification/Identity Verification Systems, pinted in Sep., 1999, 4 pages, article from Internet.

Starten Technologies Ltd, V–Card Biometrics Security Based Systems, printed in Sep., 1999, 3 pages, article from Internet.

Advanced Biometrics, Inc., The LiveGrip Access System is a closed, passive, transparent idenfication and access system, 1998, 3 pages, article from Internet.

Secugen, Secugen Corporation Product List, 1999, 2 pages, article from Internet.

(List continued on next page.)

*Primary Examiner*—Lee Young
*Assistant Examiner*—Lien M. Ngo
(74) *Attorney, Agent, or Firm*—Gardner Groff, P.C.

(57) ABSTRACT

A safety holster for a firearm, including a pivotally mounted retaining member for engaging the trigger guard of the firearm and preventing withdrawal of the firearm from the holster by anyone other than an authorized user of the firearm. The holster includes a fingerprint sensor for scanning fingerprint information of a perspective user of the firearm, and a processor for comparing the scanned fingerprint information with stored fingerprint information of an authorized user and releasing the retaining member only if the scanned fingerprint information matches that of the authorized user.

23 Claims, 13 Drawing Sheets

U.S. PATENT DOCUMENTS

| | | | | | |
|---|---|---|---|---|---|
| 4,858,799 | A | | 8/1989 | Young | |
| 4,858,800 | A | | 8/1989 | Holtzclaw, Jr. et al. | |
| 4,912,867 | A | | 4/1990 | Dukes, Jr. | |
| 4,934,574 | A | * | 6/1990 | Salandre | 224/244 |
| 5,417,000 | A | | 5/1995 | Chen | |
| 5,449,103 | A | | 9/1995 | Tilley | |
| 5,513,785 | A | | 5/1996 | Campagna, Jr. | |
| 5,518,155 | A | | 5/1996 | Gallagher | |
| 5,578,909 | A | | 11/1996 | Billen | |
| 5,603,179 | A | | 2/1997 | Adams | |
| 5,701,770 | A | | 12/1997 | Cook et al. | |
| 5,810,221 | A | | 9/1998 | Beletsky et al. | |
| 5,828,301 | A | | 10/1998 | Sanchez | |
| 5,855,305 | A | | 1/1999 | Nichols | |
| 5,916,087 | A | | 6/1999 | Owens | |
| 5,931,358 | A | * | 8/1999 | Rogers | 224/243 |
| 5,944,239 | A | | 8/1999 | Rogers et al. | |
| 5,961,013 | A | | 10/1999 | Collins | |
| 6,230,946 | B1 | | 5/2001 | Vor Keller et al. | |
| 6,267,279 | B1 | | 7/2001 | Matthews | |
| 6,320,975 | B1 | * | 11/2001 | Vieweg | 224/193 |
| 6,349,496 | B1 | | 2/2002 | Neely | |
| 2001/0032406 | A1 | | 10/2001 | Yirmiyahu et al. | |
| 2002/0032976 | A1 | | 3/2002 | Riener | |

OTHER PUBLICATIONS www.shopper.com, Input Devices, 3 pages, printed from Internet in Sep., 1999.

Protective Technologies, Inc., Protek, 5 pages, printed from Internet in Sep., 1999.

Sony On Line, Fingerprint Identification Unit, 4 pages, printed from the Internet in Sep., 1999.

Psaltis Group, Title: Optical Fingerprint Recognition, 3 pages, printed from the Internet in Sep., 1999.

Eetimes Online, Philips, WhoVision ally on Fingerprint sensors, Oct. 20, 1998, 2 pages, printed from the Internet.

www.prweb.com, Forget passwords!! Protect your computer with your fingerprint, 1997, 3 pages, printed from the Internet.

www.printrakinternational..com, Press Release, Printrak to Team with Siemens Dixdorf To Provide biometric Identification Solutions, 2 pages, printed from the Internet in Sep., 1999.

Dermalog Key, The Ultimate In Security, Dermalog Key—The safest and easiest way of access control, Jul. 18, 1998, 4 pages, printed from the Internet.

Eetimes Online, Applied Technology, Self–contained fingerprint ID systems expand security options, Dec. 7, 1998, 3 pages, printed from the Internet.

Fujitsu, Fujitsu Introduces FingerPass Card, a PC Card–Based Fingerprint Recognition Device for Mobile PC's, Aug. 19, 1998, 2 pages, printed from the Internet.

Keytronics, Secure Finger Print Scan, 1 page, printed from the Internet in Sep., 1999.

HSDH Systems, Hand Gun Safety Devices, 7 pages, printed from the Internet in Mar., 2000.

Georgia Tech, New Chip Verifies Fingerprints, May 22, 1997, 4 pages, article from the Internet.

Mitsubishi—Compact Fingerprint Checker, 2 pages, printed from the Internet in Sep., 1999.

Authentec, Inc., Personal Security for the Real World, 7 pages, printed from the Internet in Sep., 1999.

Precise Biometrics, Security is Convenience, 5 pages, printed from the Internet in Sep., 1999.

EET.com, Processor enables print ID on a card, 1999, 4 pages, printed from the Internet.

www.quicklockgunlock.com, Is Your Child Safe From Your Weapons?, 4 pages, printed in Nov. 1999 from the Internet.

www.safergunsnow.org, SaferGunsNow.org Promotes the Development and Use of Childproof Handguns, Smart Guns, Trigger Locks, Safer Guns, Personalized Guns to Help Stop Children from Killing Children with Guns, 1 page, printed from the Internet in Dec., 1999.

www.safergunsnow.org, SaferGunsNow.org Summary of Technologies of Childproof Handguns, Smart Guns, Safer Guns, Personalized Guns and High–Tech Trigger Locks. Feb. 10, 2000, 9 pages, article from the Internet.

securerite.com, Gun Trigger Lock, 1 page, printed from the Internet in Nov., 1999.

www.shotlock.com, 1000 Series Trigger Lock, 3 pages, printed from the Internet in Nov., 1999.

Smart Lock Technology, Inc., Introducing Magloc Safety Converstion For Firearms, 4 pages, printed from the Internet in Feb., 2000.

Smith & Wesson, Online Catalog Shopping, 3 pages, printed from the Internet in Oct. 1999.

IRG Intellectual Resources Group, Inc., We have a unique gunlock that stops accidental discharge and unauthorized use, 13 pages, printed from the Internet in Nov., 1999.

Ternhelm Supply Co., Inc., Magna–Trigger Gun Safety, 5 pages, printed from the Internet in Nov., 1999.

www.tvsmarketing.com, Speed Release Gun Lock, 3 pages, printed from the Internet in Nov., 1999.

Smith & Wesson, An open letter to the citizens of Boston, 4 pages, printed from the Internet in Feb., 2000.

www.chambersafe..com, When it comes to firearm safety Almost is Not Good Enough, 4 pages, printed from the Internet in Nov., 1999.

www.colt.com, Colt's Position on Personalized Weapons Technology, Nov. 10, 1998 8 pages, printed from the Internet.

www.gunindex.com, Standard Listings, 1998, 2 pages, printed from the Internet.

www.gunlocker.com, The Gunlocker, 1 page, printed from the Internet in Nov., 1999.

CNN.com, Pentagon Gets 'smart', by Ellen Messmer, Sep. 21, 1999, 3 pages, printed from the Internet.

Brigade GunLeather, Law Enforcement Holsters, 1 pages, printed from the Internet in Nov., 1999.

US News, The new smart guns, Angie Cannon, 1 page, year unknown.

www.APBNews.com, "Smart", guns on the way, J. T. Brady, Nov. 17, 1998, printed from the Internet.

www.borloc.com, The Firearms Safety Lock That Really Works, 4 pages, printed from the Internet in Nov., 1999.

www.berettausa.com, Beretta Announces Position Concerning "Smart Gun" Technology, Jan. 13, 2000, 1 page, printed from the Internet.

Dow Jones, The Wall Street Journal. 'Smart Guns' Trigger a Debate, By Paul M. Barrett, Jan. 27, 2000, 3 pages,.

www.armadillogunlock.com, The Armadillo 9000 Series Trigger Gun Locks Have the Following Standard Features, 2 page, printed from the Internet in Nov., 1999.

Kerby C. Smith, Who Needs a Smart Gun Here's a Smart Holster, Handguns, Mar. 2001, 5 pages, Michael's of Oregon.

www.unclemikes.com, Pro–3 Duty Holsters, 3 pages, Michael's of Oregon.

Dick Metcalf, Technical Editor, A High Tech Holster, Shooting Times, 3 pages, Mar., 2001.
The Smart Holster, American Handgunner, Mar., 2001, 1 page.
Smart Biometrics, Inc. Homepage, By Bobbi Jo Fuller Charge Parent for Child's Crime? Internet Article, printed Jul. 15, 2002, www.smartbiometrics.com.
www.123gunsafety.com, Imagine A Gun Safe That Works With The Touch of a Finger, Internet Article, printed Jul. 15, 2002.
Accimetrix Products and Services, www.accimetrix.com, Internet Webpage, printed Jul. 15, 2002.

* cited by examiner

SAFETY HOLSTER FOR PREVENTING ACCESS TO A FIREARM BY UNAUTHORIZED USERS

CROSS-REFERENCE TO RELATED APPLICATION

This continuation-in-part application claims the benefit of U.S. patent application Ser. No. 09/511,143, filed Feb. 23, 2000 now U.S. Pat. No. 6,230,946, and U.S. Provisional Patent Application Ser. No. 60/174,200, filed Jan. 3, 2000, the entire scope and content of which are hereby incorporated herein by reference.

TECHNICAL FIELD

The present invention relates generally to safety devices for weapons and, more particularly, to a safety holster for preventing the use of a firearm by other than an authorized user of that firearm.

BACKGROUND OF THE INVENTION

Too many deaths and injuries are caused by unauthorized users gaining access to firearms. In many instances, it is the owner or authorized user of the weapon who is the victim of the shooting. For example, during a struggle between a police officer and a suspect, the suspect may gain control of the police officer's firearm and use it against the officer. Similarly, an intruder may gain control of a homeowner's firearm during a burglary and use the firearm against the homeowner. Children also sometimes gain access to firearms and unintentionally injure themselves or others. In order to prevent such tragic consequences, or to at least reduce their incidence, it is desirable to provide some type of safety device to prevent the use of a firearm by anyone other than an authorized user. However, it is also desirable that an authorized user not be prevented from quickly accessing and firing the firearm when necessary in an emergency.

For a number of reasons, many previously known safety devices have proven less than fully satisfactory in preventing unauthorized use of a firearm and/or render the firearm too inaccessible for potential emergency use. For example, typical trigger locks are unwieldy to remove, and are not suited for use when a firearm must be available for immediate access. Many previously known security holsters do not positively lock the firearm in the holster, but instead require that the firearm be pivoted or otherwise manipulated according to a known sequence to enable removal. Such devices may not be completely effective in preventing removal and use of a weapon by an unauthorized user who knows or successfully guesses the manipulation sequence. Other devices require a user to wear a transmitter or bar code on the hand or wrist, which is recognized by the device to permit access to a firearm. Such devices have been found inconvenient as they require a user to wear a glove or transmitter at all times in order to have access to the firearm, and also are not completely effective in preventing removal and use of a weapon by an unauthorized user who obtains access to the transmitter or bar code.

Accordingly, it can be seen that a need yet exists for a safety device for preventing unauthorized persons from accessing and using a firearm. A need further exists for such a device that nonetheless allows easy and fast access to a firearm by an authorized user. A need further exists for such a device that allows access to a firearm by an authorized user without the necessity of wearing special clothing or transmitters. It is to the provision of a device meeting these and other needs that the present invention is primarily directed.

SUMMARY OF THE INVENTION

The present invention advantageously prevents access to a firearm by unauthorized users, without significantly impeding immediate access by an authorized user. Briefly described, in a preferred form the present invention comprises a safety holster for a firearm, the safety holster having a chamber for receiving at least a portion of a firearm; a retaining member pivotally mounted within the chamber for rotation between a first position for receiving and releasing a portion of the firearm and a second position for engaging a portion of the firearm to prevent removal of the firearm from the holster; locking means selectively operable between a locked position and an unlocked position, for selectively preventing movement of the retaining member from the second position to the first position; and a fingerprint sensor operatively coupled to control the locking means to unlock the locking means upon identification of an authorized user, whereby the retaining member is free to move from the second position to the first position and permit removal of a firearm from the holster.

In another aspect, the present invention is a safety holster for a firearm, the safety holster comprising a lockable retaining member for engaging a portion of a firearm to prevent unauthorized removal of the firearm from the holster; and a fingerprint sensor operatively coupled to unlock the retaining member upon identification of an authorized user.

In still another aspect, the present invention is a safety holster for a firearm, comprising a disk defining a notch, the notch adapted to cooperate with a cooperating portion of the firearm, the disk being rotational between a first position for receiving and releasing the cooperating portion of the firearm into and from the notch, and a second position for engaging the cooperating portion of the firearm within the notch to prevent withdrawal of the firearm from the holster; means for locking the disk in its second position; and means for identifying an authorized user of the firearm and releasing the locking means to permit withdrawal of the firearm from the holster.

In still another aspect, the present invention is a holster comprising a shell defining a chamber for receiving at least a portion of a firearm, the shell having a top defining a top opening, a forward portion, and a rear portion, the rear portion including a lip projecting beyond the top to restrict unauthorized removal of an ammunition clip from a firearm retained within the holster.

In another aspect, the present invention is a method of preventing unauthorized use of a firearm, comprising placing the firearm within a holster, engaging a retaining member portion of the holster with a cooperating portion of the firearm, scanning a fingerprint of a perspective user of the firearm, comparing the scanned fingerprint with fingerprint information of an authorized user of the firearm, and permitting removal of the firearm from the holster only if the scanned fingerprint matches the fingerprint information of the authorized user.

These and other objects, features, and advantages of the present invention will become more apparent upon reading the following description in conjunction with the accompanying drawing figures.

BRIEF DESCRIPTION OF THE DRAWING FIGURES

DETAILED DESCRIPTION OF THE PREFERRED EMBODIMENTS

Figure 1:
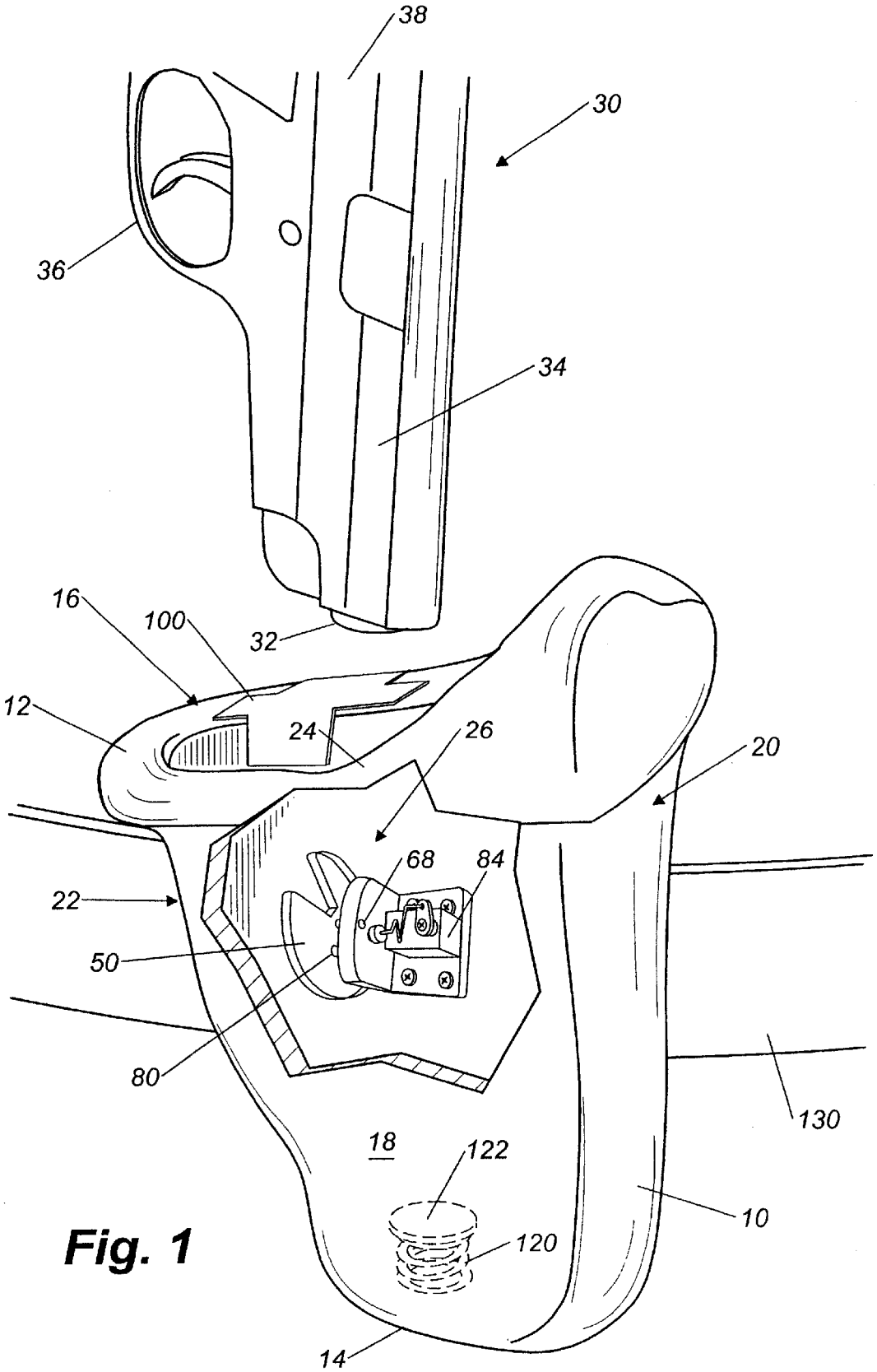
FIG. 1 is a perspective view, in partial cutaway, showing a safety holster according to a preferred form of the present invention.

Referring now to the drawing figures, wherein like reference numerals represent like parts throughout the several views, the present invention comprises a safety holster for retaining a firearm to prevent access to the firearm by persons other than authorized users. In various embodiments described herein, the holster has the general external configuration of a typical handgun holster, or another shape for receiving a portion of a handgun, and is adapted for preventing access to and/or operation of the trigger of the handgun held therein. In other embodiments described herein, the safety holster takes the form of a shroud or sleeve for preventing access to and/or operation of the trigger of a long gun such as a rifle or a shotgun. Generally described, in preferred embodiments the safety holster of the present invention comprises a retaining member for engaging a portion of a firearm, and a fingerprint sensor operatively coupled to release the retaining member upon identification of an authorized user. In this manner, the safety holster of the present invention prevents removal and use of a firearm by anyone other than an authorized user, but allows an authorized user easy and virtually unrestricted access to the firearm.

Figure 2:
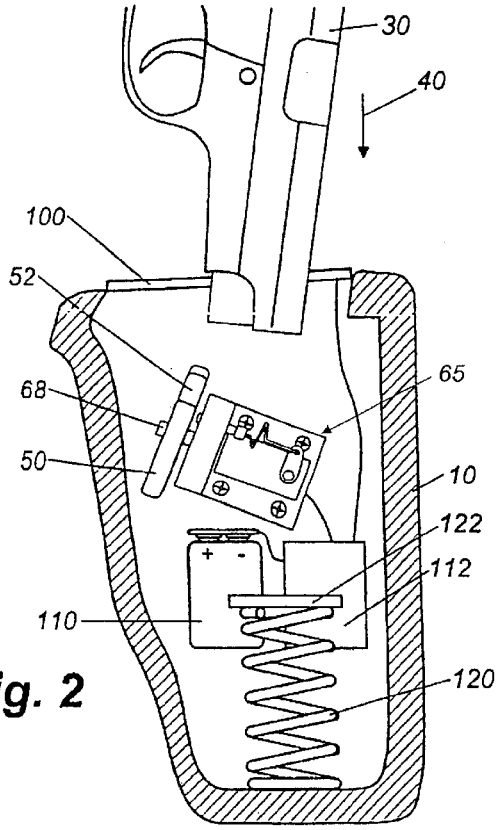
FIG. 2 is a side cross sectional view of the safety holster of FIG. 1 in a firearm-receiving orientation.
Figure 3:
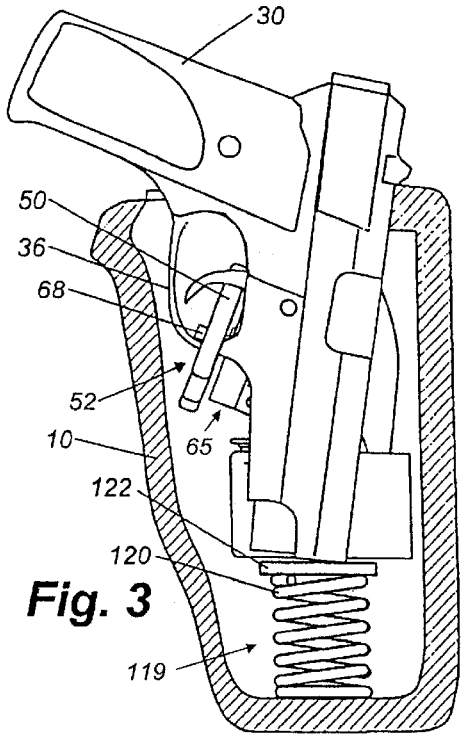
FIG. 3 is a side cross sectional view of the safety holster of FIG. 1 in a firearm-retaining orientation.

As seen best with reference to FIGS. 1–3, a first preferred embodiment of the present invention comprises a holster 10 having a top 12, a bottom 14, an inside face 16, an outside face 18, a forward face 20 and a rearward face 22. The holster 10 is preferably formed of a plastic polymeric or composite material comprising an outer shell 24 defining a chamber 26 for receiving at least a portion of a handgun 30, typically the muzzle portion 32, the barrel 34 and the trigger guard 36, while leaving at least a portion of the handle and/or receiver portion 38 of the gun exposed for access by a user. Alternate materials of construction may include one or more of the following: steel, aluminum, titanium, and/or other metals, as well as various alloys and composites thereof; glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, glass or polymer fiber reinforced plastics, and/or various combinations of the foregoing. The holster 10 is preferably a top draw holster, with the chamber 26 accessible through a top opening, whereby a handgun 30 is inserted generally in the direction of indicator arrow 40, and withdrawn in the opposite direction. For ease of use, the holster 10 preferably permits insertion and withdrawal of the firearm 30 without special manipulation. The shell 24 can be formed with one or more openings for drainage and/or ventilation in order to prevent the build-up of moisture that could cause corrosion of the firearm or holster components. It will be understood that the shell 24 can be provided of a material and with an exterior surface selected for use by itself, for use within another holster (e.g., in retrofit applications), or for use with other structures such as carrying cases and the like.

The holster 10 preferably further comprises at least one retaining member 50 for engaging a portion of the firearm 30 to prevent unauthorized removal of the firearm from the holster. As shown in FIGS. 1–4, in a preferred embodiment, the retaining member 50 comprises a disk that is pivotally (i.e., rotationally) mounted within the chamber 26. In preferred form, at least one notch 52 is formed in the retaining member 50. Each notch 52 is preferably sized, shaped and oriented to receive and engage a cooperating portion of a firearm 30, preferably at or adjacent the trigger guard portion 36 of the firearm 30. In a preferred embodiment, the notch 52 spans an arc of between about 10° to about 45°. The retaining member 50 preferably pivots between a first position, depicted in FIGS. 1 and 2, for receiving and releasing the trigger guard 36 or other cooperating portion of the firearm 30; and a second position, depicted in FIG. 3 for engaging the trigger guard 36 or other cooperating portion of the firearm 30 to prevent the unauthorized removal of the firearm from the holster. The retaining member 50 preferably traverses an arc of between 75° to 120°, and more preferably approximately 90°, in pivoting between the first position and the second position. The retaining member 50 is preferably an irregular (i.e., non-circular) element formed of a thin, rigid plate material such as, for example, 3/16" steel plate. Alternatively, the retaining member 50 can have an oval, triangular, polygonal, or other regular or irregular shape.

In a further preferred embodiment, the retaining member 50 is eccentrically mounted to pivot about an axis removed a distance from the center of mass of the retainer, whereby the notch 52 lies generally opposite the axis of rotation from the center of mass, and the retainer is weight-biased toward the above-described first position when the holster 10 is oriented with the top opening in an upward direction. In this manner, when the holster is worn by a user standing upright, the retaining member 50 is biased toward a position for receiving the firearm 30. Alternatively or additionally, the retaining member 50 can be biased toward the first position by spring, magnetic, or other biasing means.

Described in another manner, the retaining member 50 comprises a spaced pair of lobes or projections 54*a*, 54*b* (the space between the projections defining a notch such as the notch 52 in the above-described embodiment), with an engagement surface 55*a* and a catch surface 55*b*, respectively. As the firearm 30 is inserted into the holster 10, the forward outer face of the trigger guard 36 contacts the engagement surface 55*a* of the leading projection 54*a*, imparting rotation on the retaining member 50, and pivoting the catch surface 55*b* of the trailing projection 54*b* into engagement within the inner opening of the trigger guard. In alternate embodiments, the retaining member comprises one or more pivotally mounted fingers or longitudinally sliding bolts or latches mounted within the chamber 26 for engagement with a cooperating portion of the firearm 30.

More generally defined, the retaining member 50 comprises at least one cam, latch, bolt, projection, or other component with a catch surface, that moves rotationally, linearly, or otherwise into insertion into the trigger guard opening, or otherwise engages a firearm, and means for imparting movement to insert that component into the trigger guard opening or otherwise into engagement with a cooperating portion of the firearm. FIGS. 4A–4G depict several such alternative forms of the retaining member 50. It will be understood that the holster can be provided with a quantity of one or more than one of any particular type of retaining member, and/or with a combination of different types of retaining members, as may be desired.

Figure 4:
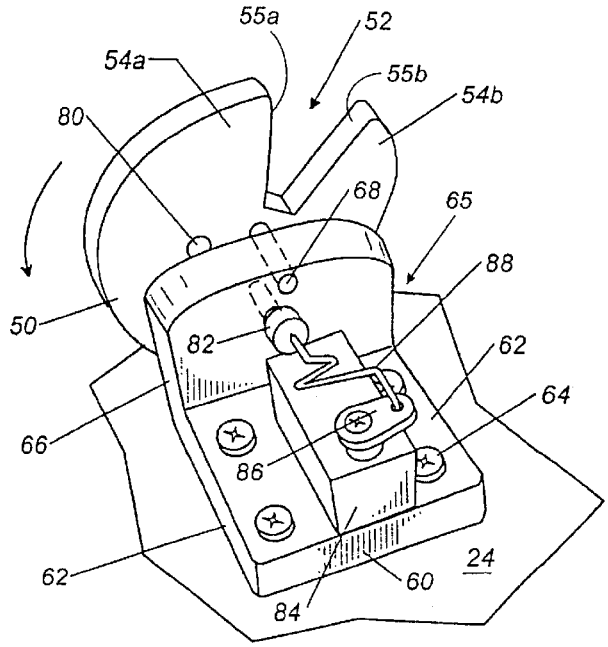
FIG. 4 is a perspective view showing greater detail of a retaining member and locking mechanism of the safety holster of FIG. 1.
Figure 4A:
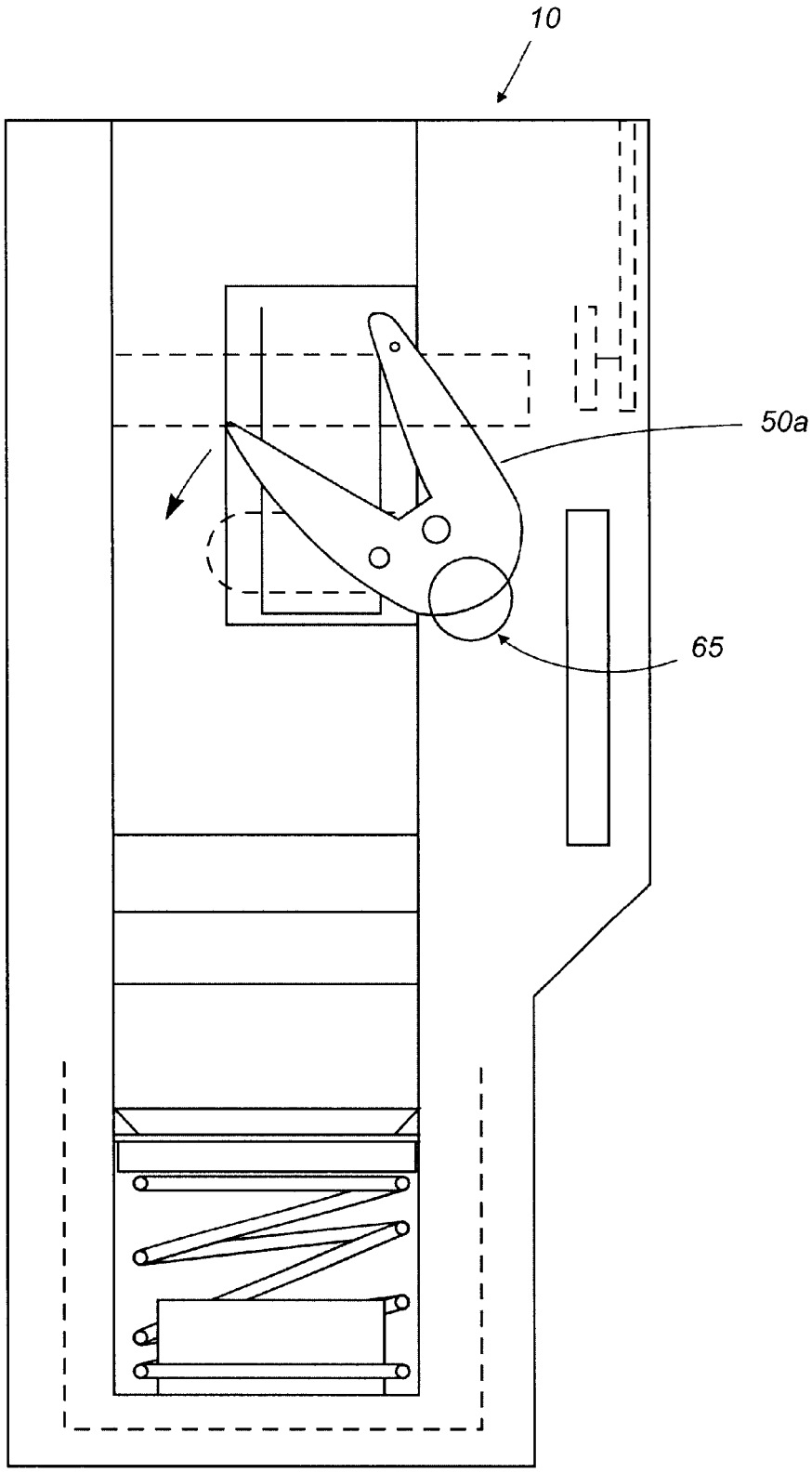
FIG. 4A is a front cross sectional view of the safety holster of FIG. 1 with an alternative retaining member having an elongate shape.
Figure 4B:
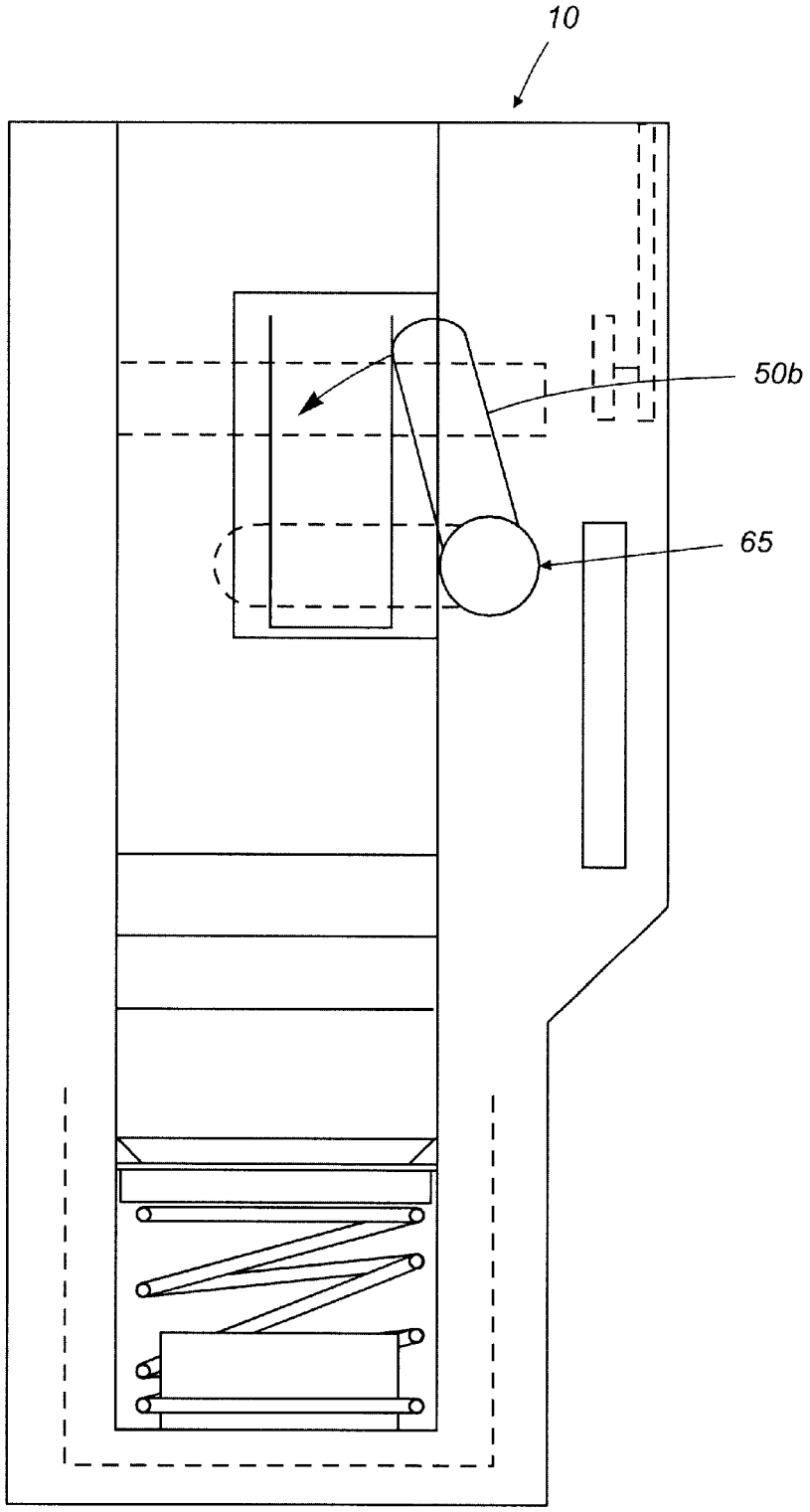
FIG. 4B is a front cross sectional view of the safety holster of FIG. 1 with an alternative retaining member provided by a pivotal cam.
Figure 4C:
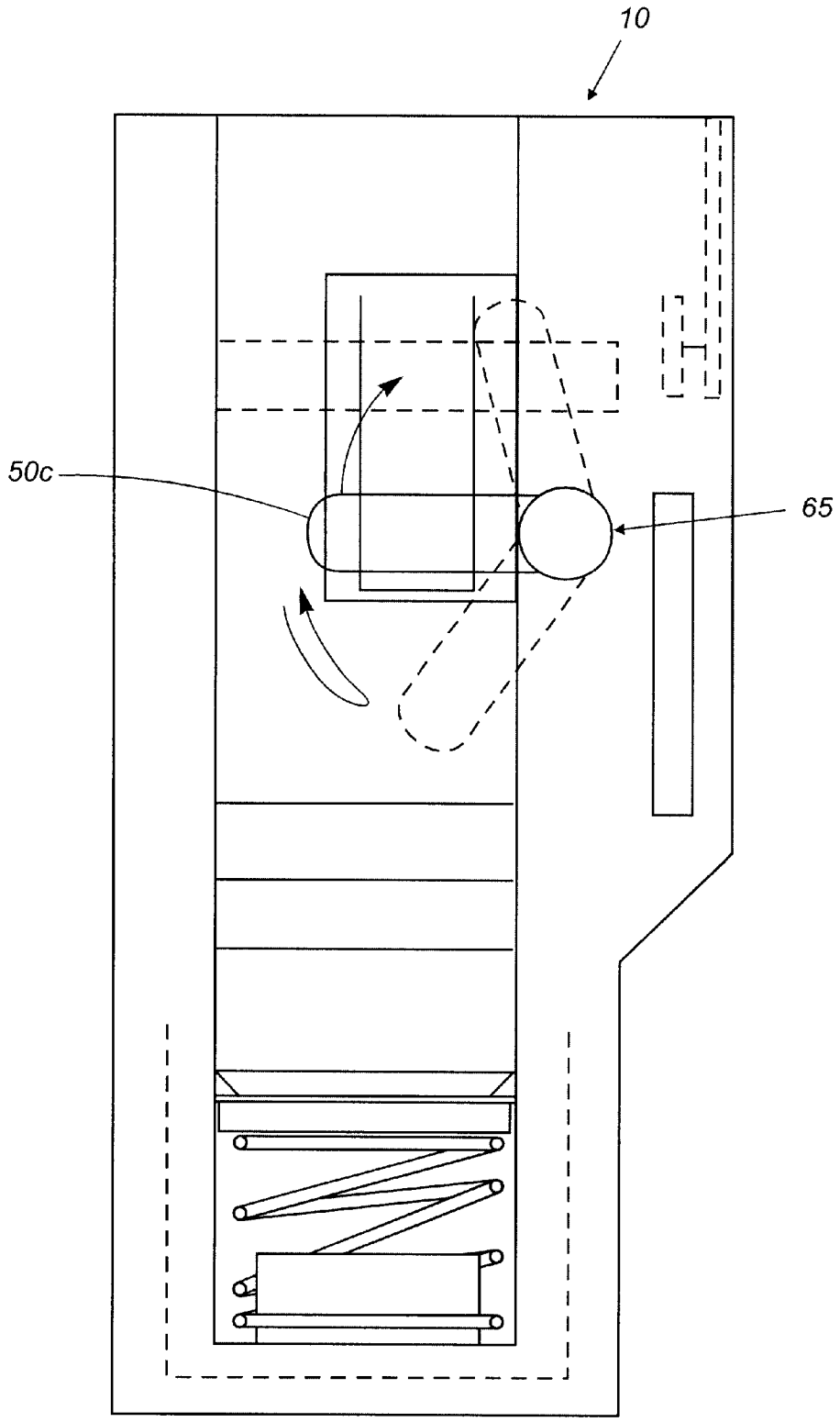
FIG. 4C is a front cross sectional view of the safety holster of FIG. 1 with an alternative retaining member provided by a spring-loaded pivotal cam.

In FIG. 4A, the retaining member 50*a* is very similar to the retaining member 50, except here the member has an elongate instead of a disk shape. In FIG. 4B, the retaining member 50*b* is provided by a cam that pivots into the trigger guard or another portion of the firearm, and that is retracted therefrom by rotation of the locking mechanism 65. In FIG. 4C, the retaining member 50*c* is provided by a spring-loaded cam that pivots downward upon engagement with the trigger guard or other portion of the firearm being inserted into the holster 10, and back up into the locked position after the guard clears the downwardly moved cam, and is then retracted rotationally upward by rotation of the locking mechanism 65.

Figure 4D:
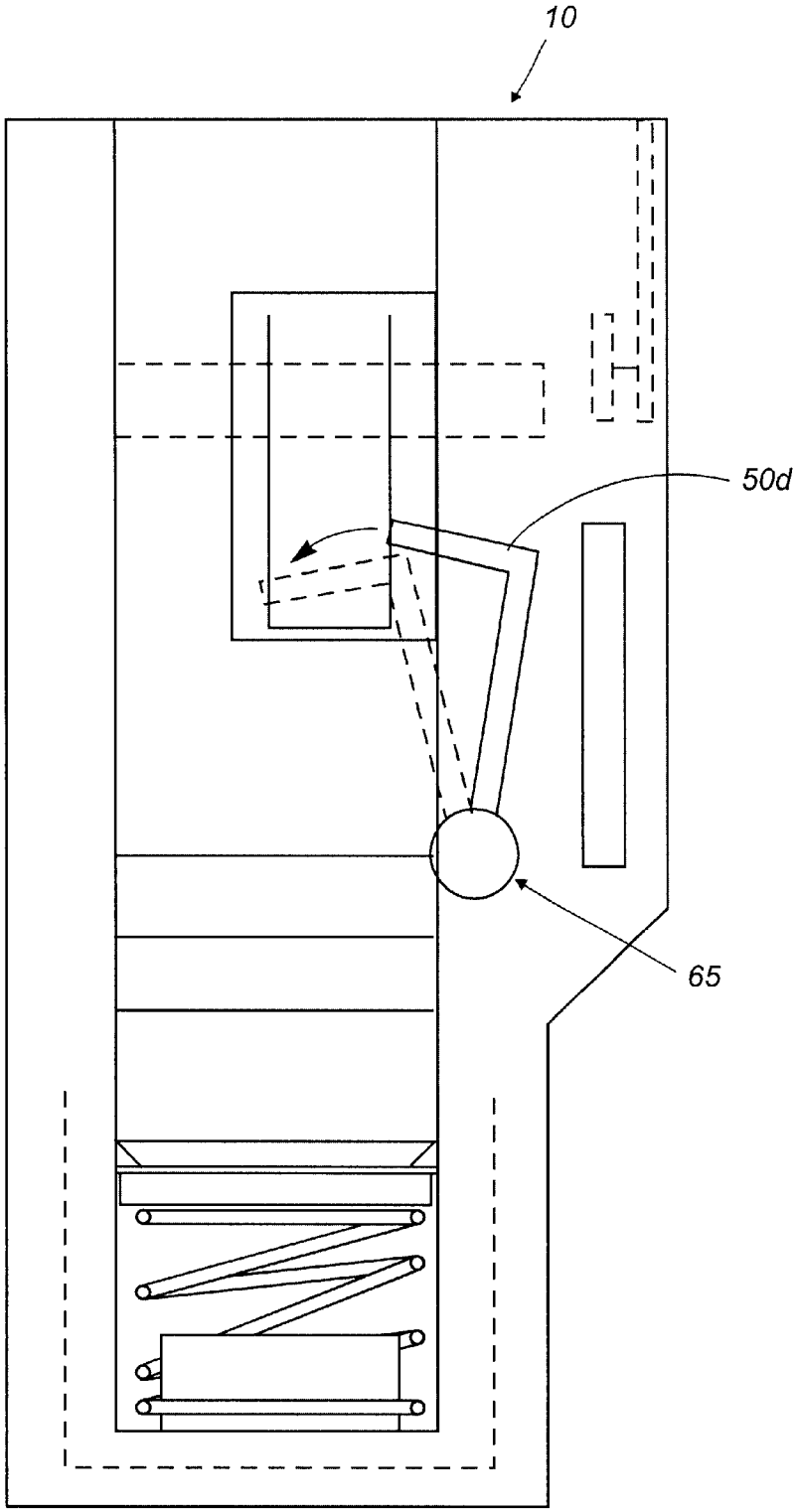
FIG. 4D is a front cross sectional view of the safety holster of FIG. 1 with an alternative retaining member provided by a rotary or pivotal latch.
Figure 4E:
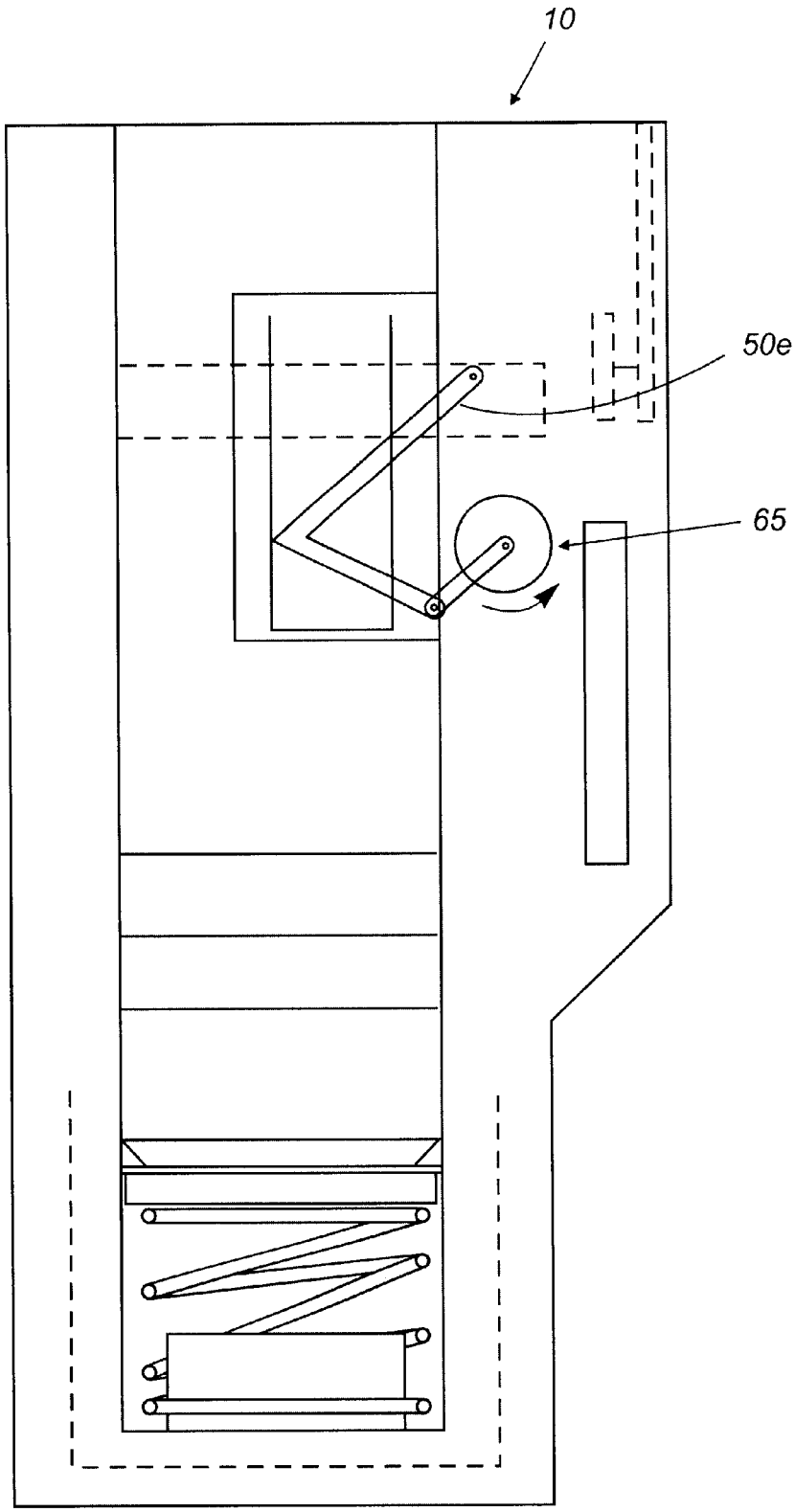
FIG. 4E is a front cross sectional view of the safety holster of FIG. 1 with an alternative retaining member provided by an L-shaped lever latch.
Figure 4F:
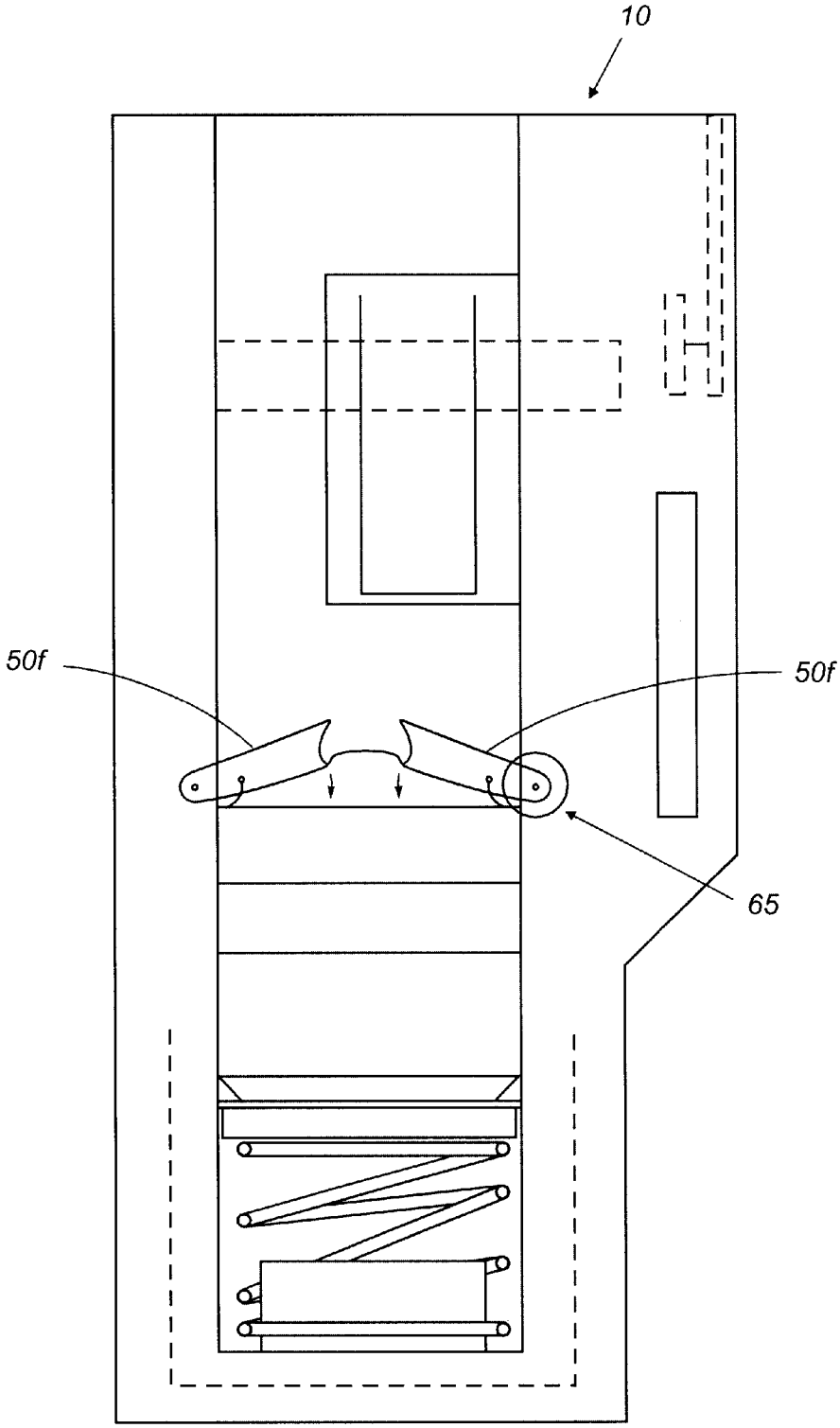
FIG. 4F is a front cross sectional view of the safety holster of FIG. 1 with an alternative retaining member provided by a set of spring-loaded cams 50*f*.
Figure 4G:
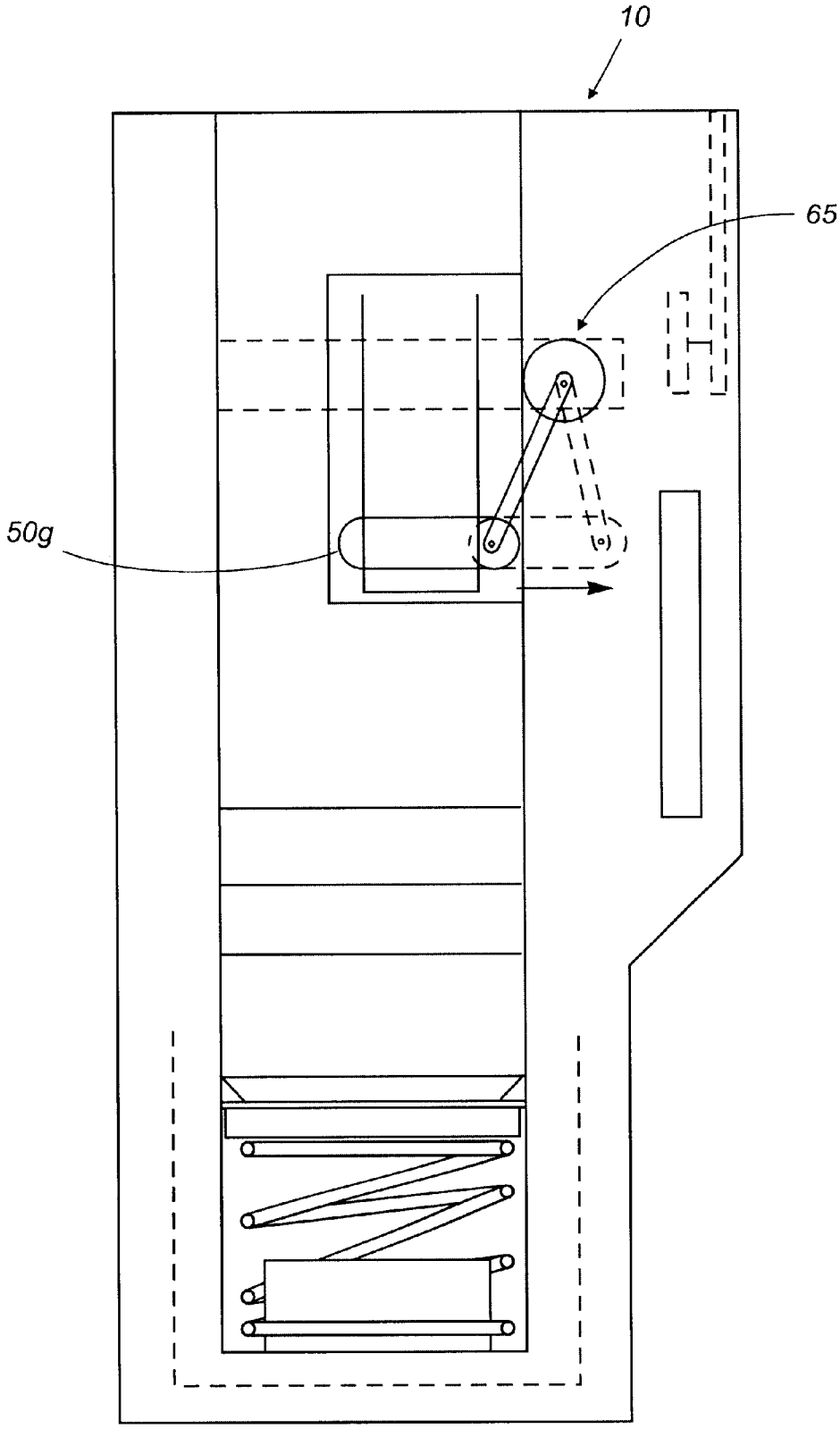
FIG. 4G is a front cross sectional view of the safety holster of FIG. 1 with an alternative retaining member provided by a slam latch or spring-biased latch.

In FIG. 4D, the retaining member 50*d* is provided by a rotary or pivotal latch with an end that rotates into the trigger guard or another portion of the firearm, and that is retracted therefrom by rotation of the locking mechanism 65. In FIG. 4E, the retaining member 50*e* is provided by an L-shaped lever with the corner of the "L" being positionable within the trigger guard or another portion of the firearm. The L-shaped lever is retracted therefrom by rotation of the locking mechanism 65. In FIG. 4F, the retaining members 50*f* are provided by a set of spring-loaded cams 50*f* with a push-bar between them that, upon engagement with the trigger guard or other portion of the firearm, snaps the cams downward and together to catch the trigger guard in securely in place. The cams 50*f* are released to pivot upward under the force of the springs and/or by the locking mechanism 65. In FIG. 4G, the retaining member 50*g* is provided by a slam latch or spring-biased latch with a latch bolt 50*g* (similar to a standard door latch) mounted to the holster 10, whereby contact between the trigger guard and the radiused or angled face of the latch bolt imparts retraction of the latch bolt and compression of the spring, and upon passage of the trigger guard over the face of the latch bolt, the spring imparts extension of the latch bolt into engagement within the trigger guard opening. The latch bolt 50*g* is then retracted by rotation of the locking mechanism 65

In another alternate embodiment, the retaining member is provided by a bayonet lock in the form of a cylinder with a slot to receive some leading portion of the firearm as it was inserted into the holster. Upon contact with the bottom of the slot, the cylinder is released to rotate and engage secondary pins or slots. The cylinder is the released by operation of the solenoid, servo, electromagnet, or other components of the lock mechanism.

In yet another alternate embodiment, a finger or other component can be caused to pivot or longitudinally extend into engagement with the trigger guard opening upon contact between the muzzle or other portion of the firearm with a strike plate or other contact surface within the holster. In one embodiment, the strike plate can also function as a lift surface component of a lift mechanism (described below), and is connected to the finger by one or more intermediate links, whereby insertion of the firearm into the holster depresses the strike plate, which is coupled by the linkage to impart movement of the finger or other component into the trigger guard opening.

The retaining member 50 is preferably rotationally mounted to a lug or projection formed integrally with the shell 24, or to a separate mounting bracket 60 attached to the shell within the chamber 26 of the holster 10. As seen best with reference to FIG. 4, in a preferred form, the mounting bracket 60 comprises a generally L-shaped component having a base panel 62 attached to the shell 24 by rivets, screws, adhesive or other attachment means 64. An upright panel 66 preferably extends generally perpendicularly from the base panel 62, away from the face of the base panel contacting the shell 24. An axle 68 is preferably provided for carrying the retaining member 50 and permitting rotation thereabout. The axle 68 preferably extends generally perpendicularly from the upright panel 66, opposite the base panel 62. In preferred form, the axle 68 is a pin having a generally circular cross-section and formed of steel or other substantially rigid material, and is carried within a through-hole formed at or adjacent the center of the disk 50. The retaining member 50 preferably rotates in a plane generally parallel to the upright panel 66, and generally perpendicular to the inside face 16 of the holster 10. The retaining member 50 is preferably mounted to the shell 24 in a position and orientation to result in rotation of the disk within a plane generally parallel to or at an acute angle relative to the direction of insertion and removal of the firearm 30 (indicated by direction arrow 40).

Referring back to FIGS. 1–4, the holster 10 of the present invention preferably further comprises a lock mechanism 65 that prevents movement of the retaining member 50 from the second, locked position to the first, released position, when the firearm 30 is held in the holster 10. In a preferred form, the lock mechanism 65 comprises locking means for preventing rotation of the retaining member 50 and having a recess or hole 80 formed in or through the retaining member 50, a pin 82 translationally mounted to the mounting bracket 60, and drive means for advancing and retracting the pin 82 into and out of engagement with the hole 80. In one embodiment, the drive means comprises a servomotor 84 for pivotally driving a crank arm 86, which is in turn coupled to the pin 82 by a connecting link 88. According to a preferred form, the connecting link 88 comprises a spring or other compressible member for storing force when the retaining member 50 is rotated into a position whereby the hole 80 is not aligned with the pin 82 and motion of the pin 82 is thereby blocked from advancement. Then, upon rotation of the retaining member 50 into its second position wherein the hole 80 becomes aligned with the pin 82, the stored force imparts advancement of the pin 82 into the hole 80.

In alternate embodiments, the drive means comprises one or more solenoids in place of the servomotor 84 for advancing and/or retracting the pin 82. The locking means can further comprise one or more springs acting to bias the pin 82 toward its advanced or retracted position. For example, a magnetically retracting solenoid can be provided in combination with a compression spring for extending the pin 82 into engagement with the retaining member 50. By appropriate coupling of springs or otherwise biasing the pin 82 toward its advanced or retracted position in the absence of force applied by the drive means, the device of the present invention provides a locked or unlocked "fail-safe" configuration, respectively. For example, in some instances, it will be preferable to configure the device to remain locked and prevent withdrawal of the firearm from the holster, even by an authorized user, in the event that the mechanism fails through loss of power or otherwise. In other instances, it may be desirable to unlock the device in the event of a failure condition, permitting withdrawal of the firearm from the holster, even by unauthorized users.

In alternate embodiments, the locking means comprises a ratchet and pawl mechanism, a slide bolt mechanism, a magnetic lock, a mechanical lock mechanism, or other linear or rotational releasable locking components for preventing release of the retaining member 50. Moreover, the locking means can comprise a portion of the retaining member 50 such as a one-way latch mechanism or other means for preventing removal of the firearm 30 from the holster 10 until released. Additionally or alternatively, the locking means can comprise a second notch (unshown) formed in the retaining member 50, and/or any combination of one or more pistons, levers or other components adapted to linearly engage another portion of the firearm 30. For example, the locking means can be configured to engage the trigger and trigger guard, the trigger guard and safety lever, the trigger and slide, or if the firearm is a revolver, the trigger guard and cylinder.

Figure 4H:
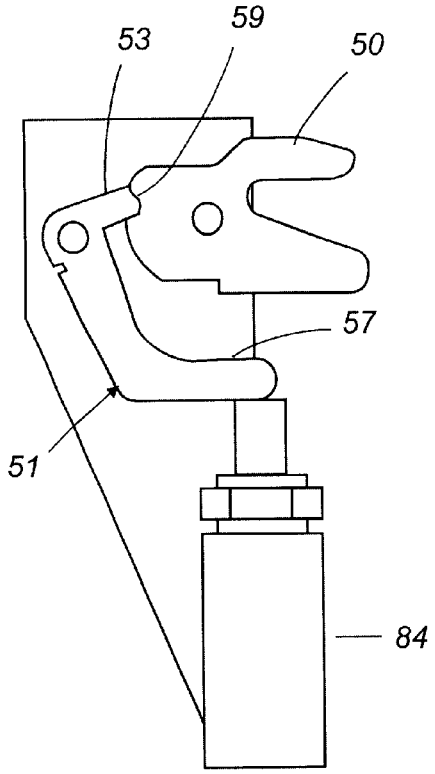
FIG. 4H is a side view of an alternative locking means having a pivotal lever with a head 53 the locks the retainer in place and an arm 57 operated by the drive means.
Figure 4J:
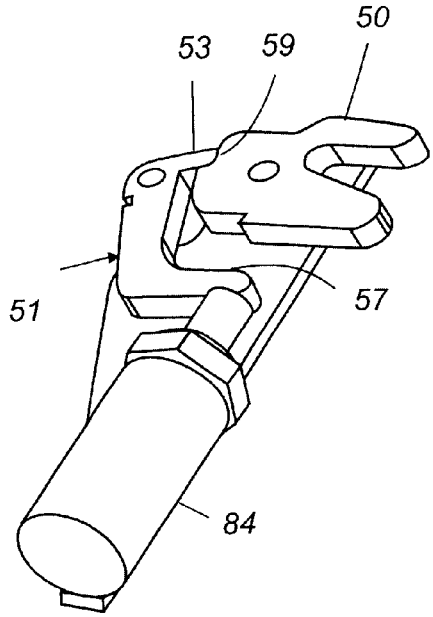
FIG. 4J is a perspective view of the locking means of FIG. 4H, showing the retainer in the second, engaged position.
Figure 4I:
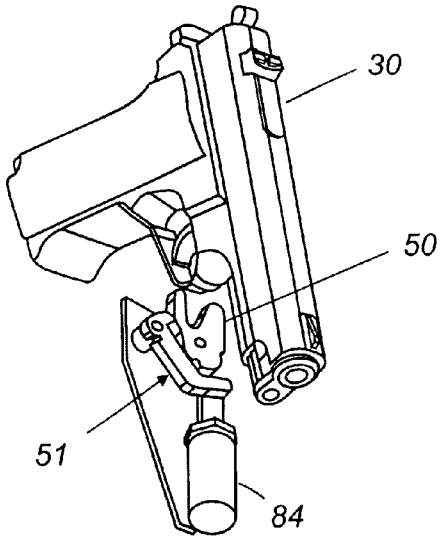
FIG. 4I is a perspective view of the locking means of FIG. 4H, showing the firearm and the retainer in the first, unlocked position.

In another form shown in FIGS. 4H–4J, the locking means comprises a pivotal lever 51 having a head 53 and an arm 57, where the head is receivable in a lock notch 59 in the retainer member 50 and the drive means 84 operates to engage the arm 57 and pivot the lever 51. FIG. 4I shows the retainer 50 in the first, unlocked position, ready to receive the trigger guard or another portion of the firearm. As described above, the retainer 50 can be urged to the first position by providing the retainer with an eccentric shape or off-center pivot point so that it is weight biased towards this position, or by a spring or other mechanism. When the firearm is inserted into the holster, the trigger guard contacts the protrusions of the retainer 50 thereby causing the retainer to pivot into the second, engaged position shown in FIG. 4J. In this position, the retainer head 53 is seated in the notch 59 to lock the retainer in place and thereby lock the firearm 30 in the holster. When an authorized user is identified by the sensor (as described below), the drive means 84 (such as a solenoid) operates to extend a pin or other portion thereof into contact with the arm 57 to pivot the lever 51. As the lever 51 pivots, the head 53 pivots out of the notch 59, freeing the retainer 50 to pivot and freeing the firearm top be withdrawn from the holster.

Referring back to FIG. 1–4, in preferred form, the holster 10 of the present invention further comprises a biometric identification means 100 such as a fingerprint sensor or other form of biometric identification means, operatively coupled to identify an authorized user and release the retaining member 50 upon identification of an authorized user. In an example embodiment, the identification means 100 is a BioController™ fingerprint sensor marketed by Smart Biometrics, Inc. of Longwood, Fla. In another embodiment, the identification means 100 is a FingerChip™ thermal silicon chip fingerprint sensor, marketed by Thomson-CSF, of Saint-Egrève, France, or the equivalent. The identification means 100 is preferably mounted adjacent the top 12 of the holster 10, between the top opening and the inside face 16, whereby the user's thumb will automatically be positioned proximal the sensor 100 during withdrawal of the firearm from the holster when the holster is worn with its inside face toward the user's body. Alternatively, the sensor 100 is mounted adjacent the top 12 of the holster 10, between the top opening and the outside face 18, whereby the index, middle or other finger(s) of the user will automatically be positioned proximal the sensor 100 during withdrawal of the firearm from the holster when the holster is worn with its inside face toward the user's body. In further alternate forms, the sensor 100 is mounted on the outside face 18, elsewhere on the holster 10 where one or more fingers or a thumb of the user can be positioned for identification, and/or a plurality of the sensors can be provided for authorization and use by more than one user.

The identification means 100 can be permanently affixed to the holster 10, or can comprise a receiver and a removable identification card, a chip, or another component, which can be removed to permanently disable the system and prevent withdrawal of the firearm 30 from the holster 10. In alternate embodiments, other forms of identification means, such as a coded keypad, bar code scanner, receiver, cornea or other eye-part sensor, facial or other body part sensor, palm reader, voice recognition system, thermal or ultrasonic imaging device, secret release button, or combinations thereof, can be provided in place of the fingerprint sensor. The identification means 100 can be configured to identify and permit access to the firearm by only a single user, or alternatively by two or more authorized users. If a removable identification means is provided, it may be configured for installation and use in only a single holster 10, or for use in any of a plurality of holsters.

A power source 110 such as a battery is preferably provided for energizing the drive means 84 and the fingerprint sensor 100. The power source 110 is preferably rechargeable (though disposable batteries can be suitably employed), and is configured to cooperate with a recharging station as described below. A microprocessor-based programmable controller 112, such as for example, a Motorola DSP56309 digital signal processor, an Oxford Micro Devices, Inc. A236 video digital signal processor (DSP) chip, an Oxford Micro Devices, Inc. A336FP fingerprint and image compression DSP chip, or equivalent, is also preferably provided, and is preferably powered by the power source 110. The controller 112 is preferably programmed and encrypted prior to assembly of the holster 10, and preferably further comprises sufficient memory for storing input fingerprint information of one or more authorized users.

In an example embodiment, the controller 112 preferably comprises a DSP chip and non-volatile memory, and is coupled to the fingerprint sensor or scanner 100. One or more signal amplifiers, transformers, additional programmable controllers, and/or other components may be provided, as desired for a particular component configuration, as can be readily determined by one of ordinary skill in the art. Information regarding the configuration of example forms of the controller 112 and associated components may be obtained from the manufacturers of a particular component, and configuration and set-up parameters are within the level of skill in the art. See, for example: *Data Sheet Summary, A236 Video Digital Signal Processor Chip*, (Oxford Micro Devices, Inc., http://www.oxfordmicrodevices.com/a236-sum.html); and/or *Application Notes for Fingerprint Processing Using the A336FP Fingerprint and Image Compression Digital Signal Processor DSP Chip*, (Oxford Micro Devices, Inc., http://www.oxfordmicrodevices.com/a336fpadv.html), each of which are incorporated herein by reference.

The controller 112 preferably stores input fingerprint information of one or more authorized users in its memory and compares fingerprint information scanned into the fingerprint sensor 100 with the stored fingerprint information of authorized users to determine whether a person attempting to use the firearm is or is not an authorized user. If the scanned fingerprint information matches that of an authorized user, the controller 112 signals the locking means to unlock and release the retaining member, permitting rotation of the retaining member from the second position to the first position, whereby the firearm can be withdrawn from the holster. If the scanned fingerprint information does not match that of an authorized user, the controller sends no signal to the locking mechanism 65, or signals the locking mechanism 65 to remain locked, and the retaining member 50 remains locked in the second position, whereby the firearm 30 cannot be withdrawn from the holster 10.

The holster 10 of the present invention can be configured for use according to one or more different modes of operation. In a first mode of operation, upon recognition of an authorized user's fingerprint information, the locking means is unlocked and remains unlocked until the firearm is withdrawn from the holster. For example, in the depicted embodiment, upon recognition of an authorized user, the controller 112 signals the solenoid or servomotor 84 to retract the pin 82 out of engagement with the hole 80, permitting the disk 50 to be rotated freely from its second position (FIG. 3) to its first postion (FIG. 2). The pin 82 remains in its retracted position until the firearm 30 is withdrawn from the holster 10. Upon release of the locking means, the firearm may be raised a small distance within the holster by the spring lift mechanism (described below), if provided, to facilitate easier withdrawal of the firearm from the holster. Withdrawal of the firearm 30 from the holster 10 can be indicated by one or more sensors or microswitches provided on the retaining member 50 or elsewhere on the holster.

According to another mode of operation, upon recognition of an authorized user's fingerprint information, the locking means is unlocked for a predetermined period of time and, if the firearm is not withdrawn from the holster during this period of time, the locking means relocks. For example, in the depicted embodiment, upon recognition of an authorized user, the controller 112 signals the servomotor 84 to retract the pin 82 out of engagement with the hole 80, permitting the disk 50 to be rotated freely from its second position (FIG. 3) to its first position (FIG. 2). The pin 82 remains in its retracted position for a predetermined duration of between less than one second to about fifteen seconds, and most preferably about one to three seconds. A timer within the controller 112 preferably measures the predetermined period of time, and after this period has elapsed, the controller signals the servomotor 84 to advance the pin 82 back into engagement with the hole 80. One or more sensors or microswitches can be provided to signal the controller 112 that the retaining member 50 has moved out of its second position by means of withdrawal of the firearm 30 from the holster 10, whereupon the controller will not signal the servomotor 84 to advance the pin 82 until the retaining member 50 returns to its second position. Alternatively, and as described in greater detail below, if the locking means comprises a compressible member, the controller 112 can activate the servomotor 84 to advance for re-engagement of the locking means without regard to the position of the retaining member 50, and the pin 82 will automatically advance into engagement with the hole 80 when the retaining member 50 returns to its second position. This embodiment eliminates the need for sensors or microswitches to monitor the position of the retaining member 50.

In preferred form, the retaining member is biased toward its first position by biasing means as discussed above when the locking mechanism 65 is unlocked and the firearm 30 is withdrawn from the holster 10. In this manner, the holster remains configured for receipt and re-engagement of the firearm when it is eventually replaced into the holster. If the locking mechanism 65 comprises a compressible member or other force-storing means, as described above, the controller 112 can be configured to activate the locking mechanism upon withdrawal of the firearm 30 from the holster 10, or after a predetermined period of time has elapsed. In this manner, energy stored in the compressible member will cause the locking mechanism 65 to automatically re-engage upon replacement of the firearm 30 into the holster 10.

For example, in the above-described embodiment, the retaining member 50 remains in its first position (FIG. 2), preferably by means of weight bias, after the firearm 30 has been withdrawn from the holster 10. In this position, the notch 52 of the retaining member 50 faces toward the opening in the top 12 of the holster 10, and the holster is configured to receive the firearm when it is replaced back into the holster. The controller 112 signals the servomotor 84 to activate and pivot the crank arm 86 in the direction of the retaining member 50. Because the hole 80 is not aligned with the pin 82, advance of the pin is blocked by the retaining member 50, resulting in compression of the connector link 88, causing energy to be stored in the compressed connector link. Contact between the pin 82 and the retaining member 50 under the influence of the compressed connector link also assists somewhat in maintaining the retaining member 50 in its first position, ready for replacement of the firearm 30 in the holster 10.

As the firearm 30 is replaced back into the holster 10, the trigger guard 36 is received within the notch 52 of the retaining member 50. Downward movement of the firearm 30 into the chamber 26 of the holster 10 toward the bottom 14 causes the retaining member 50 to rotate upon contact with the trigger guard 36 into the second position (FIG. 3)

wherein the notch 52 faces generally downwardly toward the bottom 14 of the holster. As the retaining member 50 rotates into the second position, the hole 80 is brought into alignment with the pin 82. Force imparted by the compressed link then advances the pin 82 into the hole 80, locking the retaining member 50 in the second position. In this configuration, the trigger guard 36 of the firearm 30 is engaged within the notch 52 and the retaining member 50 is locked against rotation, preventing the firearm from being removed upwardly from the holster. The shell 24 of the holster 10 prevents the firearm 30 from being moved downwardly or sideways to an extent sufficient to allow the trigger guard 36 to be released from the notch 52. As a result, the firearm is securely retained and positively locked in the holster until the locking means is disengaged.

The holster 10 preferably further comprises a lift mechanism 119 for spring-biasing or otherwise raising the firearm 30 at least a small distance (e.g., ¼" to ⅜", or more or less) within the holster upon disengagement of the locking mechanism 65. For example, the lift mechanism 119 can comprise a spring 120 that is preferably mounted against the bottom 14 within the chamber 26 of the holster 10. A padded lift surface 122 is carried by the spring 120 to contact the muzzle 32 of the firearm 30 and transmit force from the spring to the firearm without marring the surface finish of the firearm. Upon release of the locking mechanism 65, the lift mechanism 119 raises the firearm upwardly in the holster 10 to provide tactile feedback to the user that the firearm 30 has been released, and to facilitate drawing the firearm from the holster. The spring or other lift mechanism 119 preferably provides about 1–1½ lb. or another amount of lift. The lift mechanism 119 can optionally be adjustable to conform to the length and/or weight of a particular firearm, and/or to selectively vary the desired extent of lift provided.

The holster 10 preferably further comprises one or more attachment points for attaching the holster to a belt 130 of a wearer. For example, one or more slots may be formed in or adjacent the inside face 16 for receiving a belt. Alternatively, the holster 10 can comprise a clip or hook adapted to be clipped over a belt. In a further alternate embodiment, one or more quick-disconnect couplings can be provided on or adjacent the inside face 16 of the holster 10, and cooperating coupling(s) provided on a belt or on a carrier worn on a belt. Provision of quick-disconnect couplings advantageously permits the user to remove the holster for comfort, for example during driving, or for recharging of the power source, without removing the belt. In further alternate embodiments, the holster 10 can comprise an integral belt, or can comprise one or more connections for attachment to a chest or ankle harness, or a waistband; or for otherwise securing the holster to a user or the user's apparel. Typically, the inside face 16 of the holster 10 is worn against or adjacent the user's body.

Figure 5:
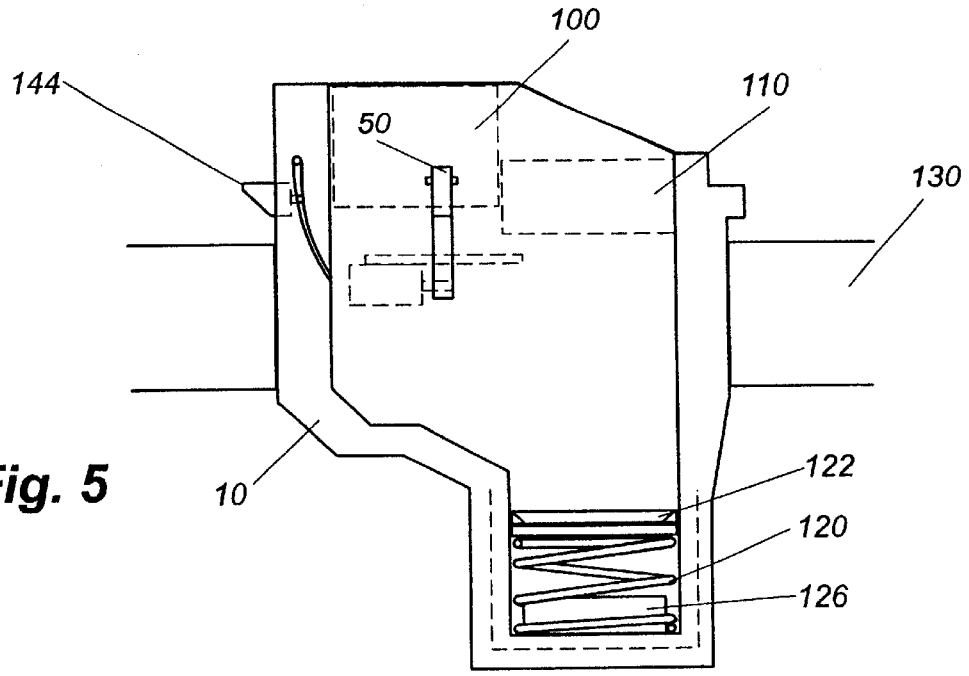
FIG. 5 is a side cross sectional view of a safety holster according to another preferred form of the present invention.
Figure 6:
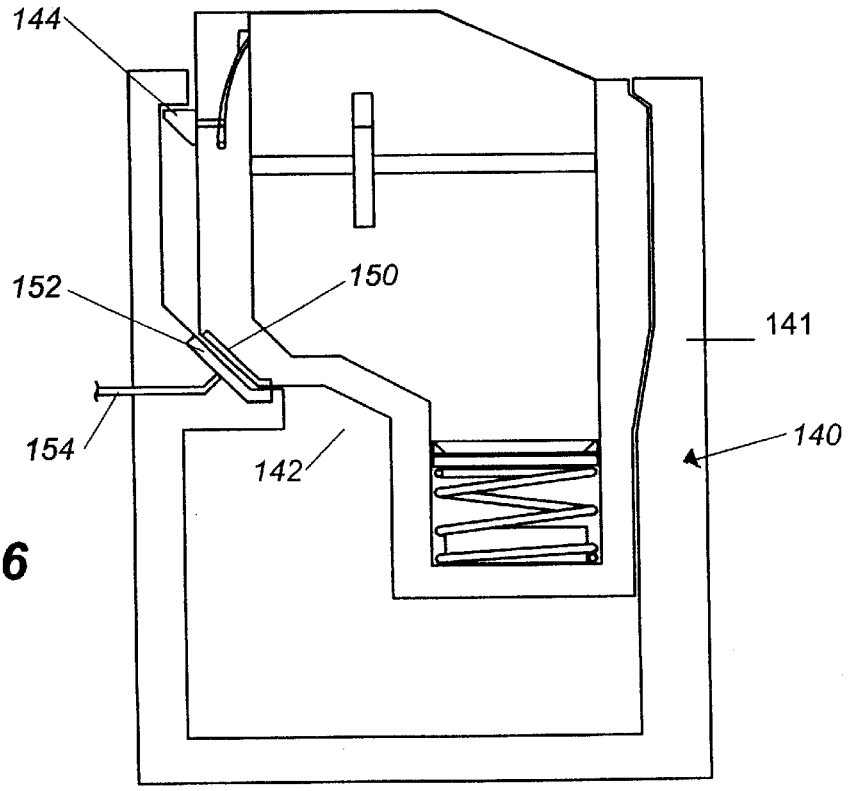
FIG. 6 is a side cross sectional view of a safety holster received in a recharging docking station according to a preferred form of the present invention.

As seen with particular reference to FIGS. 5 and 6, the present invention preferably further comprises a recharging station or docking bay 140 for recharging the battery or other portable power source 110 of the holster 10. The recharging station 140 preferably comprises a base 141 having one or more recessed portions, projections, or coupling points for releasably engaging the holster 10. In preferred form, the recharging station 140 comprises a recess 142 generally matching the outer geometry of the holster 10 or a portion thereof, whereby the holster is placed within the recess 142 for secure engagement during recharging. The recharging station 140 preferably comprises two or more contact points 152 for electrical contact with cooperating contact points 150 provided on the holster 10. One or more springs or other means for maintaining electrical contact between the cooperating contact points of the recharging station 140 and the holster 10 can be provided.

The recharging station 140 preferably further comprises a power source or a connection, such as a power cord 154, for receiving power from an external source. The recharging station 140 can be portable, or can be permanently or releasably affixed to a non-portable base surface. The recharging station 140 preferably comprises station locking means 144 for engaging and positively locking the holster 10 in the docking station to prevent unauthorized removal during charging and/or storage. For example, the recharging station 140 can be permanently affixed in the trunk or passenger compartment of a vehicle by the station locking means 144, thereby permitting law enforcement users to securely lock the holster (and if desired, a firearm within the holster) to the vehicle when off duty. The locking means of the recharging station 140 can comprise fingerprint identification means, an alphanumeric keypad, a keyed or combination lock, a biometric identification mechanism, or other means for selective release of the holster by an authorized user. Additionally or alternatively, the locking means of the recharging station can cooperate with the fingerprint scanner 100 or other identification means of the holster for verification of an authorized user and release of the locking means of the recharging station.

Figure 7:
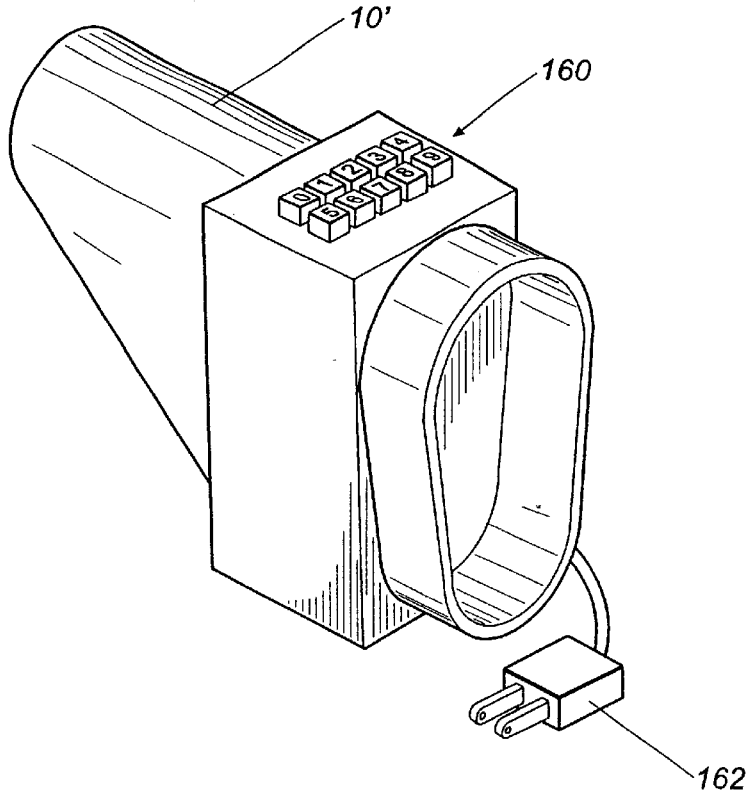
FIG. 7 is a perspective view of a safety holster according to another preferred form of the present invention.

FIGS. 5–9 depict additional preferred embodiments and features of the holster and associated components of the present invention. For example, the holster 10 of FIG. 5 includes an energy absorbing errant discharge pad 126 beneath the spring 120 and lift surface 122 for absorbing the impact of a round of ammunition accidentally discharged within the holster and thereby preventing injury to the wearer. The discharge pad 122 can be made of a conventional ballistic material such as KEVLAR™, LEXAN™, KYDEX™, BALLISTICA PLEXIGLAS™, or the like. Also, the pad 122 can be mounted onto the spring lift mechanism 119 for increased energy absorption. FIG. 7 depicts holster 10' provided with a keypad 160 or other releasable locking means, mounted onto or separate from a recharging station 90 (described above), and a power cord and plug 162 for connection to an external power source, for use in securing the holster in an automobile trunk, a cabinet, or another location.

Figure 8:
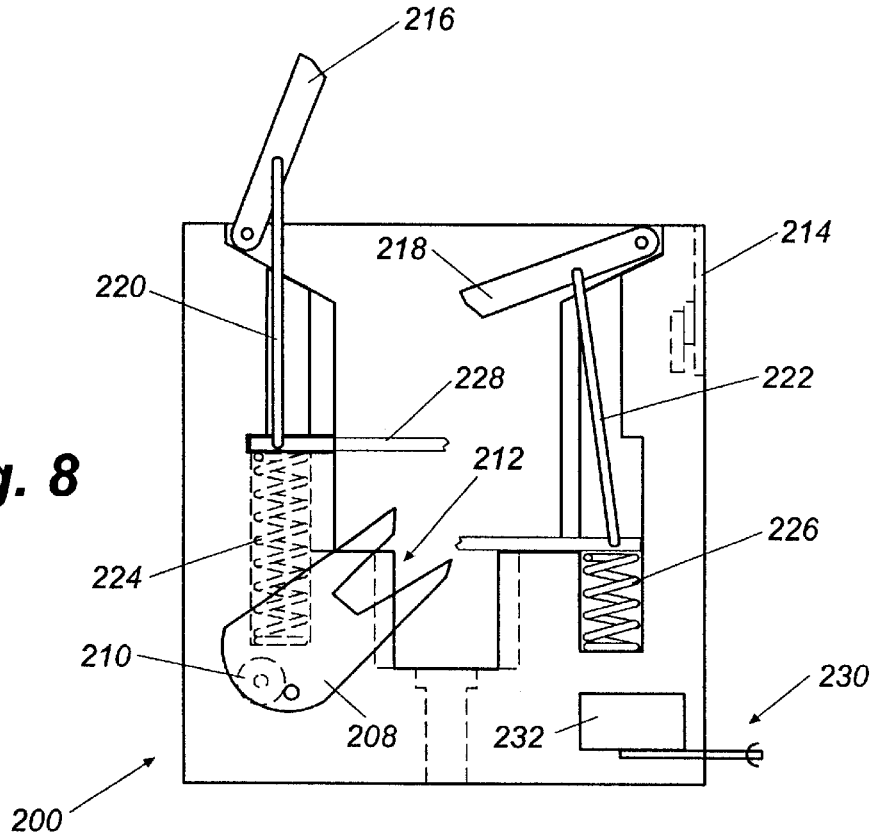
FIG. 8 is a front cutaway view of a safety holster for a rifle or other long gun according to a preferred form of the present invention.

FIG. 8 shows an end view of a sleeve type holster 200 for securing a rifle, shotgun or other long gun. A pivotal disc or other form of retaining member 208 (similar to the retaining member 50 of the previously-described embodiment) engages the firearm, such as by receiving the trigger guard of the firearm within the notch 212, or as otherwise described herein. A solenoid 210 or other drive means is preferably provided to actuate the locking means in a substantially similar manner as described above. One or more cover plates 216, 218 are preferably hingedly mounted over the channel or opening which receives at least the trigger guard portion of the firearm. The cover plates 216, 218 are preferably joined by links 220, 222 to a push-plate 228, and biased by one or more springs 224, 226 or other biasing means. The firearm is aligned with the axis of its barrel perpendicular to the plane of FIG. 8, with the trigger guard generally aligned with the disc 208. The firearm is then deposited downwardly through the top opening of the holster, and the trigger guard or other portion is engaged within the notch 212, causing the disc 208 to pivot from its first position to its second position. The locking means is actuated to lock the disc 208 in the second position to prevent removal of the firearm. To access the firearm, an authorized user scans his or her fingerprint into the fingerprint sensor 214, and upon recognition of an authorized user, the processor signals the locking means to release, permitting the disc 208 to pivot from its second position to its first position, and allowing removal of the firearm from the holster 200. A battery 232 and means 230 for connection to an external power source are preferably provided in similar fashion to that described above.

Additionally, the errant discharge chamber can be adapted for use with the rifle holster by, for example, attaching extension plates, tubes, or bars to the sides of the locking system and mounting the errant discharge chamber at the end. Another way to do this would be to extend the forward portion of the locking station using a channel configured to fit around the long gun barrel, similar to a piece of channel iron with the 'U' facing up or out. The long gun user would then slip the barrel into the errant discharge chamber and then lay the gun into the channel where the locking device would then engage the firing chamber, trigger guard etc.

Figure 9:
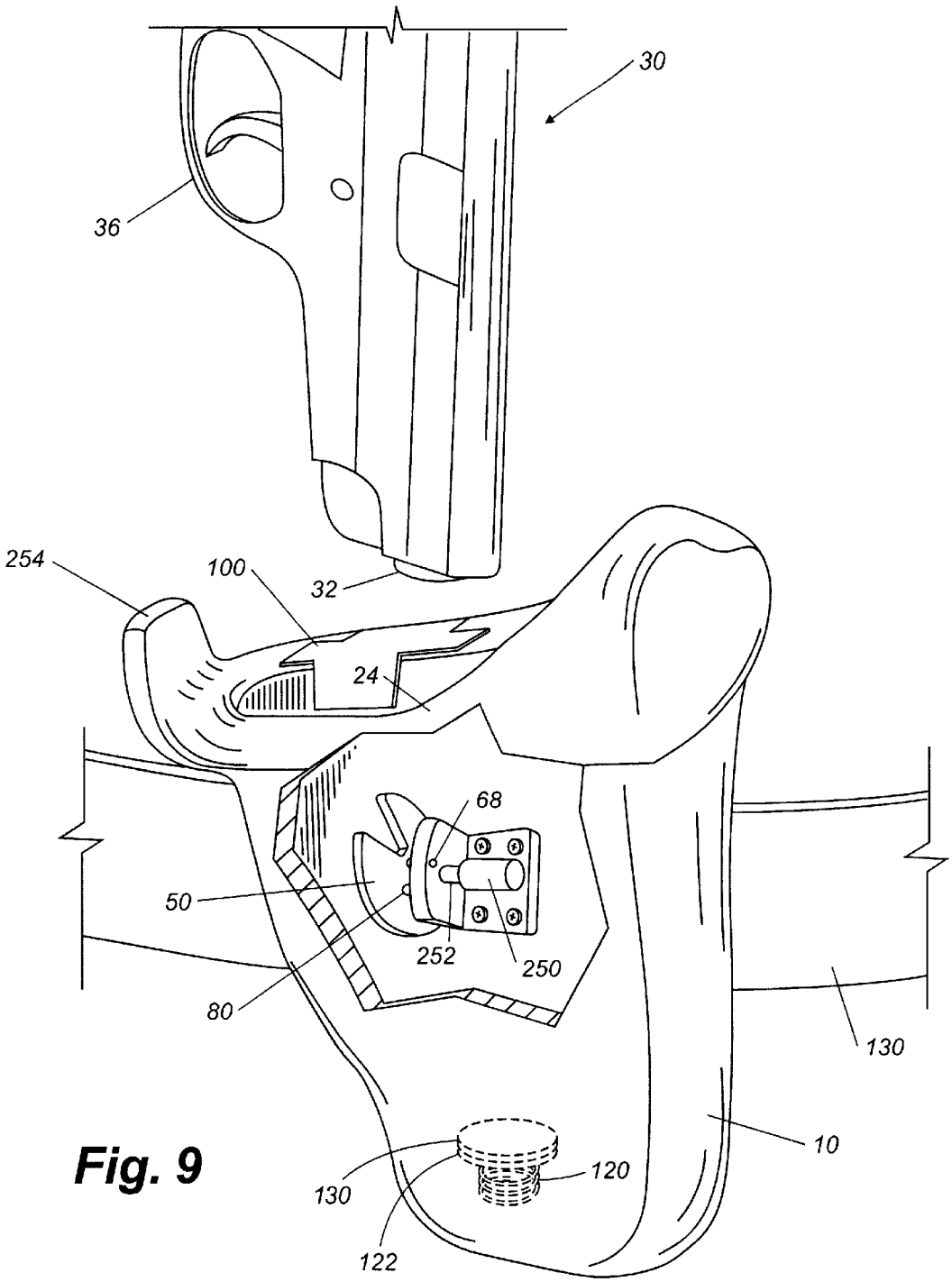
FIG. 9 is a perspective view, in partial cutaway, showing a safety holster according to another preferred form of the present invention.

FIG. 9 shows a holster 10, which is substantially similar to the holster described above with reference to FIGS. 1–4, but having a solenoid 250 in place of the servomotor 84. The solenoid preferably advances and retracts a shaft 252 into and out of engagement with the hole 80, in response to signals received from the processor (unshown), to lock the disk 50 in its second position to prevent removal of the firearm 30.

Referring further to FIG. 9, the present invention optionally further comprises a disabling mechanism that renders the firearm unusable if an unauthorized user tampers with the holster and/or the docking station in an attempt to access the firearm. For example, a strip of magnesium 130 can be embedded in the holster and/or the docking station, preferably about the circumference of the firearm proximal the muzzle, the trigger, or at another point on the firearm whereby the strip of magnesium is ignited upon sensing attempted tampering by an unauthorized user, thereby rendering the firearm unusable. Alternatively or additionally, a strip or seam of liquid, semi-liquid, powder or combination thereof, of quick or instantaneously setting epoxy, liquid metal, or other similar compound can be embedded in the holster and/or docking station for release upon sensing attempted tampering by an unauthorized user, thereby rendering the firearm unusable. Alternatively or additionally, the identification means and/or logic chip can be configured to disable the holster and/or the docking station to prevent removal of the firearm upon sensing attempted tampering. The user would then have to return the holster to the manufacturer or an authorized service provider to reset the unit and return it to normal operation. Alternatively or additionally, if a removable fingerprint sensor card or chip is provided, the identification and/or logic chips can be encrypted to accept signals only from the sensor card or chip of one or more authorized users, whereby in the event that a "foreign" card or chip is installed, the holster and/or docking station will disable until reactivated by the authorized user or an authorized servicer.

The tamper fail-safe system can include one or more simple star bridges, also known as a torque stress sensors, similar to those used in robots and remote control systems. For example, sensors produced by US Robotics can be suitably employed. The sensors can be attached to the holster by epoxy or another known attachment means for sensing mechanical tampering with the safety holster. Each sensor is attached to the holster shell at a point that might be affected by tampering with the gun or the holster shell, such as the retaining member, the mounting plate, the locking pin, the solenoid or servo, and so forth. When any of the sensors detects stress or pressure, it sends a digital signal to the chip set. Additionally or alternatively, the system can be activated by attempting to use unauthorized software, electronics, or by attempting to decipher the encryption used to activate the safety device. The chip set then shuts down the biometric recognition device/s and powers up a small capacitor. The capacitor would be in line at all times so the additional power needed to create the necessary amperage to fire the thermite (or other explosive material) strip or release the epoxy would be minimal. Upon detection of continued tampering, the capacitor would discharge firing the fail-safe disabling mechanism, thereby rendering the firearm useless. The entire function could be contained inside the safety holster so that no one is injured when the thermite ignites.

The present invention further encompasses a holster configured to prevent unauthorized removal of an ammunition clip installed in a firearm secured in the holster. For example, as seen with reference to FIG. 9, the shell 24 of the holster defines a chamber for receiving at least a portion of the firearm 30. The top of the shell 24 defines a top opening bounded by a forward portion and a rear portion, for providing passage of the firearm 30 into the chamber. The rear portion preferably includes a lip 254 projecting generally upwardly beyond the top of the holster. When a firearm having an ammunition clip housed in its grip is contained in the holster 10, the extension of the lip blocks retraction of the clip and thereby restricts unauthorized removal of an ammunition clip from a firearm retained within said holster. The configuration of holster 10 to include the lip 254 for preventing unauthorized removal of an ammunition clip installed in a firearm can be provided separately from, or in combination with the identification means.

Additionally, the invention can comprise a system wherein authorized users can connect the safety holster to personal communication devices such as radios, cell phones, handheld computers, etc. For example, a police officer could link his or her holster to the communication system that he wears such that when the retaining member is moved to the open position permitting the firearm to be drawn, a signal is sent to a police station or home office that the officer has drawn his weapon. This might be of use when the officer wants to draw the weapon and remain quite and still alert his station that he might need help.

Additionally, the safety holster could have signaling means for indicating a low battery, that the holster has been tampered with, that the device is now deactivated and must be returned to an authorized dealer for repair or reactivation, etc. If the fail-safe has been activated, the authorized user should be able to tell and either be able to deactivate it or take it to some one authorized to deactivate it. If the fail-safe has fired and thereby destroyed the weapon, it should be apparent to the user.

A further signaling means that would be useful to law enforcement and the military, for example, would be an alert signal sent to the police station or military command from the holster when it has been disconnected from a radio alert system, and a global positioning system or the like to aid in locating the firearm, safety holster, and/or police officer if he is unable to communicate. The signaling means could comprise a set of contacts in the safety holster that would close a circuit to send the desired signal through the officer's radio unit.

The present invention further comprises a method of preventing unauthorized use of a firearm. According to preferred form, the method of the present invention comprises providing a holster substantially as described and depicted herein. The method preferably further comprises placing a firearm within the holster and engaging a retaining member portion of the holster with a cooperating portion of the firearm. In further preferred embodiments, the retaining member comprises a notched disk that rotates between a first position for receiving and releasing the trigger guard of a firearm and a second position for retaining the firearm in the holster, and the holster comprises locking means to secure the retaining member in place to prevent unauthorized withdrawal of the firearm from the holster. A prospective user of the firearm scans their fingerprint using a fingerprint sensor portion of the holster. A processor compares the scanned fingerprint information with stored fingerprint information of an authorized user of the firearm, and permits removal of the firearm from the holster only if the scanned fingerprint information matches that of the authorized user.

The holster of the present invention also enables a method allowing a purchaser to obtain a firearm, which is disabled from use pending completion of a background check. The firearm can locked in the holster by the seller, and the fingerprint scanner and/or other identification means removed or disabled to prevent removal of the firearm from the holster. Upon successful completion of the background check, the fingerprint scanner and/or other identification means is replaced or enabled, allowing the purchaser to access and use the firearm. In further preferred embodiments, upon completion of a background check the state agency may forward the purchaser or an approved firearms dealer an indication of the successful clearance, along with an encrypted release code, via the Internet, email, or other computer network. By downloading the release code to the holster's microprocessor, the holster is enabled to permit the purchaser to access and use the firearm.

The present invention also enables a method of verifying the identity of a potential purchaser and user of a firearm prior to allowing access to and use of the firearm. For example, an authorized dealer of firearms will require the potential purchaser to provide a fingerprint scan to be uploaded to the memory of the holster to allow the user to access the firearm according to the above-described method of use. This fingerprint scan can then be compared to a database of fingerprint information of convicted criminals, such as those maintained by the Federal Bureau of Investigation or various other law enforcement agencies. If the scanned fingerprint information of the potential user matches that of a known criminal, the holster is not enabled. If the potential user successfully passes the background check and the scanned fingerprint information does not indicate a match, the holster is enabled for use with the scanned fingerprint information. In this manner, so long as the firearm is stored in the holster, the firearm cannot be used by persons obtaining stolen firearms or by persons purchasing firearms from parties other than authorized dealers having access to the encrypted information necessary to upload fingerprint information of authorized users into the holster's memory.

While the invention has been shown and described in preferred forms, it will be apparent to those skilled in the art that many modifications, additions, and deletions can be made therein without departing from the spirit and scope of the invention as set forth in the following claims.

What is claimed is:

1. A safety holster for a firearm, comprising:

a retaining member having an engagement surface formed thereon and a catch surface formed thereon, said retaining member being pivotal between a first position wherein the firearm is not constrained by said catch surface and the firearm can be withdrawn from said holster and a second position wherein said catch surface engages and constrains a cooperating portion of the firearm to prevent withdrawal of the firearm from said holster, and wherein said engagement surface is disposed on the retaining member so that, when the firearm is inserted into the holster with said retaining member in said first position, the cooperating portion of the firearm contacts said engagement surface and pivots said retaining member to said second position;

a lock operatively coupled to said retaining member and adapted to secure said retaining member in said second position;

an actuator operatively coupled to said lock; and means for identifying an authorized user of the firearm and actuating said actuator to release said lock to permit withdrawal of the firearm from said holster.

2. The safety holster of claim 1, wherein said retaining member is selected from the group consisting of notched disks, elongate disks, rotary or pivotal cams, spring-loaded cams, rotary or pivotal latches, L-shaped lever latches, spring-loaded cooperating cam sets, and slam or spring-biased latches.

3. The safety holster of claim 1, wherein said retaining member engagement surface is disposed facing said retaining member catch surface, said engagement surface and said catch surface define a notch, and said notch is adapted to receive the cooperating portion of the firearm.

4. The safety holster of claim 3, wherein said retaining member has at least two projections, wherein said engagement surface is formed on one of said projections and said catch surface is formed on another one of said projections.

5. The safety holster of claim 1, wherein said lock comprises a hole formed in said retaining member and a translationally-mounted pin, and said actuator is operable for advancing and retracting said pin into and out of engagement with said hole in said retaining member.

6. The safety holster of claim 1, wherein said lock comprises a lock notch formed in said retaining member, a pivotal lever having a head and an arm, wherein said lever is pivotal between a first locked position and a second unlocked position, wherein when said lever is in said first locked position and said retaining member is in said second position, said head is received in said lock notch to prevent said retainer member from pivoting to said first position, and a drive means operable to engage said arm and to pivot said lever to said second unlocked position.

7. The safety holster of claim 1, wherein said identifying means comprises a fingerprint sensor.

8. The safety holster of claim 1, wherein said retaining member is an eccentric disk that is weight-biased toward said first position when said holster is oriented in an upright position.

9. The safety holster of claim 1, further comprising means for disabling the firearm secured therein upon sensing tampering by an unauthorized user.

10. The safety holster of claim 1, further comprising a lift mechanism disposed within said holster that biases the firearm within the holster toward an opening in said holster.

11. A safety holster for a firearm, comprising:

a shell having an opening for receiving a portion of the firearm within said shell while leaving a portion of the firearm exposed external of said shell for access by a user;

a retaining member pivotally mounted to said shell, said retaining member having at least two projections with an engagement surface formed on one of said projections and a catch surface formed on another one of said projections, said engagement surface and said catch surface defining a notch, said notch adapted to receive a cooperating portion of the firearm, said retaining member being pivotal between a first position wherein the firearm is not constrained by said catch surface and the firearm can be withdrawn from said shell and a second position wherein said catch surface engages and constrains a cooperating portion of the firearm to prevent withdrawal of the firearm from said shell, and wherein said engagement surface is disposed on the retaining member so that, when the firearm is inserted into the shell with the retaining member in the first position, the cooperating portion of the firearm contacts said engagement surface and pivots said retaining member to the second position;

means for locking said retaining member in said second position; and a fingerprint sensor operatively coupled to said locking means for identifying an authorized user of the firearm and releasing said locking means to permit withdrawal of the firearm from said holster.

12. The safety holster of claim 11, wherein said locking means comprises a hole formed in said retaining member, a translationally-mounted pin, and drive means for advancing and retracting said pin into and out of engagement with the hole in said retaining member.

13. The safety holster of claim 11, wherein said locking means comprises a lock notch formed in said retaining member, a pivotal lever having a head and an arm, wherein said lever is pivotal between a first locked position and a second unlocked position, wherein when said lever is in said first locked position and said retaining member is in said second position, said head is received in said lock notch to prevent said retainer member from pivoting to said first position, and a drive means operable to engage said arm and to pivot said lever to said second unlocked position.

14. The safety holster of claim 11, wherein said retaining member is an eccentric disk that is weight-biased toward said first position when said holster is oriented in an upright position.

15. The safety holster of claim 11, further comprising means for disabling the firearm secured therein upon sensing tampering by an unauthorized user.

16. The safety holster of claim 11, further comprising a lift mechanism disposed within said holster that biases the firearm within the holster toward an opening in said holster.

17. The safety holster of claim 11, further comprising an errant discharge absorption pad disposed on the holster adjacent the position of the muzzle of the firearm when inserted in the holster.

18. The safety holster of claim 11, further comprising a power source for energizing said drive means and said identifying means.

19. The safety holster of claim 18, wherein said power source has first contacts connected thereto, and further comprising a docking bay having a base with a recessed portion for receiving said shell, and second contacts that electrically engage said first contacts when said shell is received in said docking bay, for recharging said power source.

20. A safety holster for a firearm, comprising:

a retaining member having a catch surface formed thereon, said retaining member being moveable between a first position wherein the firearm is not constrained by said catch surface and the firearm can be withdrawn from said holster and a second position wherein said catch surface engages and constrains a cooperating portion of the firearm to prevent withdrawal of the firearm from said holster;

a lock operatively coupled to said retaining member and adapted to secure said retaining member in said second position, wherein said lock comprises a lock notch formed in said retaining member, and a pivotal lever having a head and an arm, wherein said lever is pivotal between a first locked position and a second unlocked position, wherein when said lever is in said first locked position and said retaining member is in said second position, said head is received in said lock notch to prevent said retainer member from pivoting to said first position, and a drive means operable to engage said arm and to pivot said lever to said second unlocked position; and means for identifying an authorized user of the firearm and releasing said lock to permit withdrawal of the firearm from said holster.

21. A safety holster for a firearm, comprising:

a retaining member having a catch surface formed thereon, said retaining member being moveable between a first position wherein the firearm is not constrained by said catch surface and the firearm can be withdrawn from said holster and a second position wherein said catch surface engages and constrains a cooperating portion of the firearm to prevent withdrawal of the firearm from said holster;

a lock operatively coupled to said retaining member and adapted to secure said retaining member in said second position, wherein said lock comprises a lock notch formed in said retaining member, a pivotal lever having a head and an arm, wherein said lever is pivotal between a first locked position and a second unlocked position, wherein when said lever is in said first locked position and said retaining member is in said second position, said head is received in said lock notch to prevent said retainer member from pivoting to said first position, and a drive means operable to engage said arm and to pivot said lever to said second unlocked position;

means for identifying an authorized user of the firearm and releasing said lock to permit withdrawal of the firearm from said holster; and a lift mechanism disposed within said holster that biases the firearm within the holster toward an opening in said holster.

22. A safety holster fare firearm, comprising:

a retaining member having a catch surface formed thereon, said retaining member being moveable between a first position wherein the firearm is not constrained by said catch surface and the firearm can be withdrawn from said holster and a second position wherein said catch surface engages and constrains a cooperating portion of the firearm to prevent withdrawal of the firearm from said holster;

a lock operatively coupled to said retaining member and adapted to secure said retaining member in said second position, wherein said lock comprises a lock notch farmed in said retaining member, a pivotal lever having a head and an arm, wherein said lever is pivotal between a first locked position and a second unlocked position, wherein when said lever is in said first locked position and said retaining member is in said second position, said head is received in said lock notch to prevent said retainer member from pivoting to said first position, and a drive means operable to engage said arm and pivot said lever to said second unlocked position;

means for identifying an authorized user of the firearm and releasing said lock to permit withdrawal of the firearm from said holster; and an errant discharge absorption pad disposed on said holster adjacent the position of the muzzle of the firearm when inserted in said holster.

23. The safety holster of claim 1, further comprising an errant discharge absorption pad disposed on said holster adjacent the position of the muzzle of the firearm when inserted in said holster.

* * * * *